US011408145B2

(12) United States Patent
Kouno et al.

(10) Patent No.: US 11,408,145 B2
(45) Date of Patent: Aug. 9, 2022

(54) WORK VEHICLE AND HYDRAULIC CONTROL METHOD

(71) Applicant: KOMATSU LTD., Tokyo (JP)

(72) Inventors: Kiichirou Kouno, Tokyo (JP); Tadashi Mori, Tokyo (JP)

(73) Assignee: KOMATSU LTD., Tokyo (JP)

( * ) Notice: Subject to any disclaimer, the term of this patent is extended or adjusted under 35 U.S.C. 154(b) by 906 days.

(21) Appl. No.: 16/305,463

(22) PCT Filed: Sep. 21, 2016

(86) PCT No.: PCT/JP2016/077849
§ 371 (c)(1),
(2) Date: Nov. 29, 2018

(87) PCT Pub. No.: WO2018/055696
PCT Pub. Date: Mar. 29, 2018

(65) Prior Publication Data

US 2020/0325654 A1 Oct. 15, 2020

(51) Int. Cl.

| | |
|---|---|
| ***E02F 9/22*** | (2006.01) |
| ***E02F 3/32*** | (2006.01) |
| ***E02F 3/42*** | (2006.01) |
| ***E02F 3/43*** | (2006.01) |

(Continued)

(52) U.S. Cl.
CPC ..... *E02F 9/2228* (2013.01); *E02F 3/32* (2013.01); *E02F 3/425* (2013.01); *E02F 3/435* (2013.01); *E02F 9/2267* (2013.01); *E02F 9/2271* (2013.01); *E02F 9/2292* (2013.01);
(Continued)

(58) Field of Classification Search
CPC ..... E02F 9/2239; E02F 9/2221; E02F 9/2292; E02F 3/425; E02F 9/2228; E02F 9/2267
See application file for complete search history.

(56) References Cited

U.S. PATENT DOCUMENTS

| | | | |
|---|---|---|---|
| 5,852,934 | A | 12/1998 | Chung et al. |
| 6,234,201 | B1 | 5/2001 | Strobel |
| 7,992,384 | B2 | 8/2011 | Itakura et al. |

(Continued)

FOREIGN PATENT DOCUMENTS

| | | | |
|---|---|---|---|
| CN | 101180469 | A | 5/2008 |
| CN | 101631974 | A | 1/2010 |

(Continued)

*Primary Examiner* — Abiy Teka
(74) *Attorney, Agent, or Firm* — Faegre Drinker Biddle & Reath LLP

(57) ABSTRACT

A work vehicle includes a valve for switching between a merging position for causing a first oil passage for driving a bucket and a second oil passage for driving an arm to communicate with each other, and a diverging position for separating the first oil passage and the second oil passage. The work vehicle is adapted to switch the valve from the merging position to the diverging position, when one of a pump pressure in the first pump and a pump pressure in the second pump comes to be equal to a predetermined value during an excavation operation. The work vehicle is adapted to control both pumps, such that the amount of the oil discharged from the first pump is larger than the amount of the oil discharged from the second pump, when the pump pressure in the first pump is equal to or more than the predetermined value.

6 Claims, 11 Drawing Sheets

(51) Int. Cl.
*F15B 15/02* (2006.01)
*F15B 21/00* (2006.01)

(52) U.S. Cl.
CPC ..... *F15B 15/02* (2013.01); *F15B 21/001* (2013.01); *E02F 9/2285* (2013.01); *E02F 9/2296* (2013.01)

(56) References Cited

U.S. PATENT DOCUMENTS

| | | | | |
|---|---|---|---|---|
| 2006/0230752 | A1 | 10/2006 | Sawada | |
| 2007/0125078 | A1 | 6/2007 | Tanaka et al. | |
| 2009/0056324 | A1* | 3/2009 | Itakura | E02F 9/2235 60/421 |
| 2010/0095664 | A1 | 4/2010 | Hyodo et al. | |
| 2014/0144129 | A1 | 5/2014 | Shirao et al. | |
| 2014/0158235 | A1 | 6/2014 | Suk et al. | |
| 2015/0040552 | A1* | 2/2015 | Hashimoto | F15B 11/16 60/429 |
| 2015/0066313 | A1* | 3/2015 | Hirozawa | E02F 9/2246 701/50 |

FOREIGN PATENT DOCUMENTS

| | | | |
|---|---|---|---|
| CN | 103958943 | A | 7/2014 |
| EP | 2 743 517 | A1 | 6/2014 |
| JP | S62-251504 | A | 11/1987 |
| JP | H06-040406 | U | 5/1994 |
| JP | H09-268604 | A | 10/1997 |
| JP | 2004-036681 | A | 2/2004 |
| JP | 2014-522952 | A | 9/2014 |
| JP | 5771332 | B2 | 8/2015 |
| JP | 2016-036874 | A | 3/2016 |
| KR | 10-2008-0016589 | A | 2/2008 |
| WO | WO 2005/019656 | A1 | 3/2005 |
| WO | WO-2005/047709 | A1 | 5/2005 |
| WO | WO-2006/123704 | A1 | 11/2006 |

* cited by examiner

WORK VEHICLE AND HYDRAULIC CONTROL METHOD

TECHNICAL FIELD

The present invention relates to a work vehicle and a hydraulic control method for such a work vehicle.

BACKGROUND ART

Work vehicles such as hydraulic excavators have been required to have reduced fuel expenses and improved workability.

For example, National Patent Publication No. 2014-522952 (PTL 1) discloses a hydraulic control system aimed at preventing pressure losses in hydraulic pumps. The hydraulic control system includes a first hydraulic pump, a second hydraulic pump, an arm cylinder, a bucket cylinder, an arm operation apparatus, a bucket operation apparatus, a first arm control valve, a second arm control valve, a bucket control valve, and a merging release valve.

The first arm control valve is provided in a flow passage between the first hydraulic pump and the arm cylinder and is adapted to control the activation, stoppage and direction switching of the arm cylinder when the first arm control valve is switched by operating the arm operation apparatus. The second arm control valve is provided in a flow passage between the second hydraulic pump and the arm cylinder and is adapted to supply the discharge flow rate of the second hydraulic pump to the arm cylinder through merging, by being switched when a control signal generated by operating the arm operation apparatus exceeds a set value.

The bucket control valve is provided in a flow passage between the second hydraulic pump and the bucket cylinder and is adapted to control the activation, stoppage and direction switching of the bucket cylinder when the bucket control valve is switched by operating the bucket operation apparatus. The merging release valve is provided in a flow passage between the second hydraulic pump and the second arm control valve.

This hydraulic control system is adapted to release the merging function, during compound operations for concurrently operating the arm and the bucket for performing excavation operations. Thus, the arm cylinder is driven by being supplied with a hydraulic oil only from the first hydraulic pump, out of the first hydraulic pump and second hydraulic pump. The bucket cylinder is driven by being supplied with the hydraulic oil only from the second hydraulic pump. With this structure, in the hydraulic control system, an attempt is made to prevent pressure losses in the hydraulic pumps during compound operations.

Japanese Patent Laying-Open No. 9-268604 (PTL 2) discloses a flow-rate merging device for heavy equipment including a first hydraulic pump and a second hydraulic pump. The flow-rate merging device includes a pilot flow-passage ON-OFF valve adapted to open and close a pilot flow passage according to predetermined external signals. The flow-rate merging device is adapted to selectively perform the merging function of merging an actuator for the second hydraulic pump with an actuator for the first hydraulic pump, depending on the operating condition of the actuator for the second hydraulic pump. With this structure, in the flow-rate merging device, an attempt is made to smoothly perform compound operations with the actuators, thereby improving the workability of the equipment.

WO2005/047709 (PTL 3) discloses a hydraulic control device capable of suppressing occurrences of flow fluctuations before and after switching of a diverging/merging valve for improving the manipulability and the working efficiency. This hydraulic control device is capable of accurately determining the timings of switching of the diverging/merging valve. Therefore, with the hydraulic control device, it is possible to suppress energy losses due to pressure losses in pressure compensation valves and to improve the working efficiency during compound operations with plural hydraulic actuators.

CITATION LIST

Patent Literature

PTL 1: National Patent Publication No. 2014-522952
PTL 2: Japanese Patent Laying-Open No. 9-268604
PTL 3: WO2005/047709

SUMMARY OF INVENTION

Technical Problem

During an excavation operation, a bucket is rotated during the latter half of the operation and, therefore, the load on the bucket tends to be increased during the latter half of the operation. Therefore, even if the merging function is stopped during the excavation operation as in PTLs 1 and 2, when the amount of the hydraulic oil supplied to the arm from one hydraulic pump is equal to the amount of the hydraulic oil supplied to the bucket from the other hydraulic pump, the speed of excavation by the bucket cannot be increased.

The present disclosure is made in view of the aforementioned problem and aims at providing a work vehicle capable of increasing the speed of excavation by a bucket for efficiently performing excavation operations and at providing a hydraulic control method for this work vehicle.

Solution to Problem

According to an aspect of the present invention, there is provided a work vehicle including: a bucket; an arm; a first hydraulic pump and a second hydraulic pump each for discharging a hydraulic oil; a first hydraulic oil passage through which the hydraulic oil discharged from the first hydraulic pump flows to drive the bucket; a second hydraulic oil passage through which the hydraulic oil discharged from the second hydraulic pump flows to drive the arm; a diverging/merging valve for switching between a merging position for causing the first hydraulic oil passage and the second hydraulic oil passage to communicate with each other, and a diverging position for separating the first hydraulic oil passage and the second hydraulic oil passage from each other; and a controller for controlling an amount of the hydraulic oil discharged from the first hydraulic pump, an amount of the hydraulic oil discharged from the second hydraulic pump, and an operation of the diverging/merging valve. The controller causes the diverging/merging valve to switch from the merging position to the diverging position, when one of a pump pressure in the first hydraulic pump and a pump pressure in the second hydraulic pump comes to be equal to a first predetermined value during an excavation operation. The controller controls the first hydraulic pump and the second hydraulic pump, such that the amount of the hydraulic oil discharged from the first hydraulic pump is larger than the amount of the hydraulic oil discharged from the second hydraulic pump, when the pump pressure in the first hydraulic pump is equal to or more than the first predetermined value.

With the aforementioned structure, when one of the pump pressure in the first hydraulic pump and the pump pressure in the second hydraulic pump comes to be equal to or more than the first predetermined value during an excavation operation, the first hydraulic oil passage and the second hydraulic oil passage are brought into the state of being separated from each other. Further, when the pump pressure in the first hydraulic pump is equal to or more than the first predetermined value, the amount of the hydraulic oil discharged from the first hydraulic pump is larger than the amount of the hydraulic oil discharged from the second hydraulic pump. Therefore, the amount of the oil supplied to the bucket side is larger than the amount of the oil supplied to the arm side. This can suppress the reduction of the speed of excavation by the bucket. Accordingly, it is possible to efficiently perform excavation operations, in comparison with structures adapted to make the amount of the oil supplied to the arm side be equal to the amount of the oil supplied to the bucket side.

Preferably, the controller controls the first hydraulic pump and the second hydraulic pump, such that the amount of the hydraulic oil discharged from the first hydraulic pump is larger than the amount of the hydraulic oil discharged from the second hydraulic pump, when one of the pump pressure in the first hydraulic pump and the pump pressure in the second hydraulic pump is equal to or more than a second predetermined value that is smaller than the first predetermined value.

With the aforementioned structure, when one of the pump pressure in the first hydraulic pump and the pump pressure in the second hydraulic pump is equal to or more than the second predetermined value that is smaller than the first predetermined value, it is possible to suppress the reduction of the speed of excavation by the bucket.

Preferably, the work vehicle further includes a sensor for detecting the pump pressure in the first hydraulic pump. The controller increases a proportion of the amount of the hydraulic oil discharged from the first hydraulic pump to the amount of the hydraulic oil discharged from the second hydraulic pump, as a value of a result of detection by the sensor increases.

With the aforementioned structure, the pump pressure is increased as the load on the bucket side is increased. Therefore, by increasing the proportion of the amount of the hydraulic oil discharged from the first hydraulic pump to the amount of the hydraulic oil discharged from the second hydraulic pump, as the value of the result of detection by the sensor increases, it is possible to suppress the reduction of the speed of excavation by the bucket, even if the load on the bucket side is gradually increased.

Preferably, the controller causes the diverging/merging valve to switch from the diverging position to the merging position, when one of the pump pressure in the first hydraulic pump and the pump pressure in the second hydraulic pump comes to be equal to or lower than a third predetermined value that is smaller than the first predetermined value, after the diverging/merging valve is switched from the merging position to the diverging position.

With the aforementioned structure, after returning from the diverging position to the merging position, in order to cause the switching from the merging position to the diverging position, again, there is a need for an increase of the pump pressure by an amount corresponding to the difference between the first predetermined value and the third predetermined value. Therefore, it is possible to prevent the diverging/merging valve from being immediately returned, again, to the diverging position, after being returned from the diverging position to the merging position.

Preferably, the controller controls the first hydraulic pump and the second hydraulic pump, such that the amount of the hydraulic oil discharged from the first hydraulic pump is larger than the amount of the hydraulic oil discharged from the second hydraulic pump, until the diverging/merging valve is switched from the diverging position to the merging position, after the diverging/merging valve is switched from the merging position to the diverging position.

With the aforementioned structure, while the first hydraulic oil passage and the second hydraulic oil passage are in the state of being separated from each other, it is possible to make the amount of the oil supplied to the bucket side be larger than the amount of the oil supplied to the arm side.

Preferably, the work vehicle further includes a first actuator for driving the bucket, a second actuator for driving the arm, a first main operation valve, connected to the first hydraulic oil passage, for supplying the hydraulic oil to the first actuator, a second main operation valve for supplying the hydraulic oil discharged from the first hydraulic pump to the second actuator, through the first hydraulic oil passage, a first pressure compensation valve provided between the first actuator and the first main operation valve, and a second pressure compensation valve provided between the second actuator and the second main operation valve. The second pressure compensation valve performs an operation for increasing a differential pressure between an inlet-side port and an outlet-side port of the second pressure compensation valve to make a differential pressure between an inlet-side port of the second main operation valve and the outlet-side port of the second pressure compensation valve be equal to a differential pressure between an inlet-side port and an outlet-side port of the first main operation valve, when a differential pressure between the inlet-side port and an outlet-side port of the second main operation valve comes to be lower than the differential pressure between the inlet-side port and the outlet-side port of the first main operation valve.

With the aforementioned structure, the pressure compensation is performed on the second main operation valve, when control is performed for making the amount of the hydraulic oil discharged from the first hydraulic pump be larger than the amount of the hydraulic oil discharged from the second hydraulic pump. This can reduce the amount of the hydraulic oil supplied to the second actuator. This can suppress the reduction of the amount of the hydraulic oil supplied to the first actuator.

According to another aspect of the present invention, there is provided a hydraulic control method that is executed for a work vehicle including a diverging/merging valve for switching from one position of a merging position and a diverging position to the other position of the merging position and the diverging position, the merging position being for causing a first hydraulic oil passage and a second hydraulic oil passage to communicate with each other, the diverging position being for separating the first hydraulic oil passage and the second hydraulic oil passage from each other, the first hydraulic oil passage being a hydraulic oil passage through which a hydraulic oil discharged from a first hydraulic pump flows to drive a bucket, and the second hydraulic oil passage being a hydraulic oil passage through which the hydraulic oil discharged from a second hydraulic pump flows to drive an arm. The hydraulic control method includes the steps of: switching the diverging/merging valve from the merging position to the diverging position; and controlling the first hydraulic pump and the second hydraulic pump such that an amount of the hydraulic oil discharged from the first hydraulic pump is larger than an amount of the hydraulic oil discharged from the second hydraulic pump.

With the aforementioned structure, when one of the pump pressure in the first hydraulic pump and the pump pressure in the second hydraulic pump comes to be equal to or more than the first predetermined value during an excavation operation, the first hydraulic oil passage and the second hydraulic oil passage are brought into the state of being separated from each other. Further, when the pump pressure in the first hydraulic pump is equal to or more than the first predetermined value, the amount of the hydraulic oil discharged from the first hydraulic pump is larger than the amount of the hydraulic oil discharged from the second hydraulic pump. Therefore, the amount of the oil supplied to the bucket side is larger than the amount of the oil supplied to the arm side. This can suppress the reduction of the speed of excavation by the bucket. Accordingly, it is possible to efficiently perform excavation operations, in comparison with structures adapted to make the amount of the oil supplied to the arm side be equal to the amount of the oil supplied to the bucket side.

Advantageous Effects of Invention

According to the present invention, it is possible to efficiently perform excavation operations, by increasing the speed of excavation by the bucket.

DESCRIPTION OF EMBODIMENTS

Figure 1:
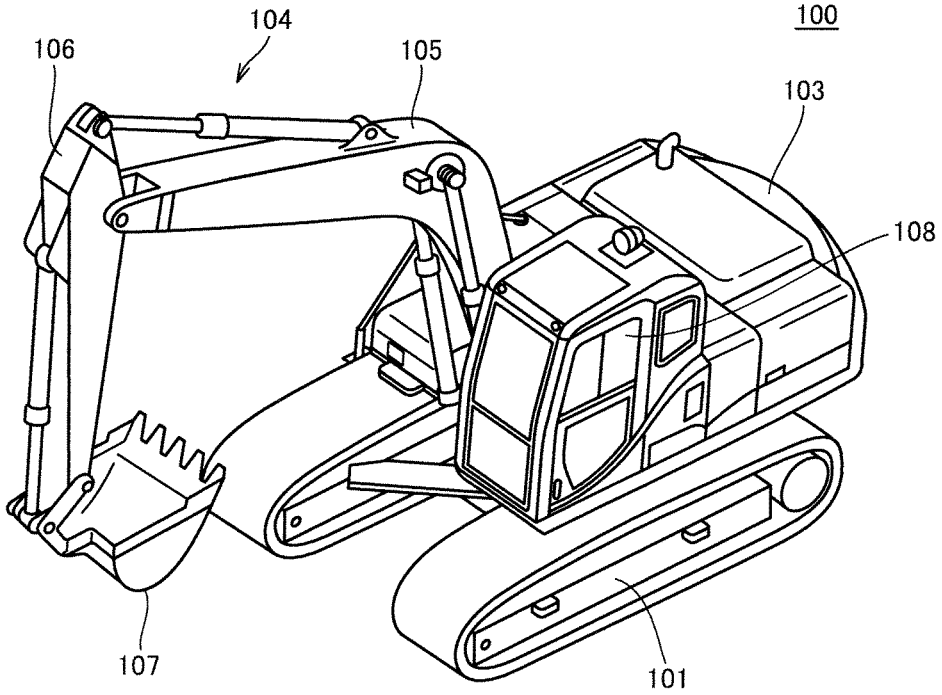
FIG. 1 is a view illustrating an external appearance of a work vehicle.

Hereinafter, embodiments will be described with reference to the drawings. In the following description, the same component parts will be denoted with the same reference numerals and characters. These same component parts have the same designations and the same functions. Accordingly, these same component parts will not be described in detail, redundantly.

It is originally intended that structures according to the embodiments are used in combination as required. Further, some of the components are not used in some cases.

Hereinafter, a work vehicle will be described with reference to the drawings. Further, in the following description, the terms "upper", "lower", "front", "rear", "left" and "right" are terms defined with respect to an operator sitting on an operator's seat in the work vehicle.

First Embodiment

<Entire Structure>

FIG. 1 is a view illustrating the external appearance of a work vehicle 100 according to an embodiment. As illustrated in FIG. 1, in the present example, a hydraulic excavator will be mainly exemplified as work vehicle 100, in the description.

Work vehicle 100 mainly includes a traveling member 101, a revolving member 103, and a work implement 104. A work-vehicle main body is constituted by traveling member 101 and revolving member 103. Traveling member 101 includes a pair of left and right crawler belts. Revolving member 103 is revolvably mounted therein through a revolving mechanism at an upper portion of traveling member 101.

Work implement 104 is pivotally supported in revolving member 103 such that work implement 104 can operate in the upward and downward directions and, thus, work implement 104 performs operations such as excavation of gravels. Work implement 104 includes a boom 105, an arm 106, and a bucket 107. Boom 105 has a base portion that is movably coupled to revolving member 103. Arm 106 is movably coupled to the distal end of boom 105. Bucket 107 is movably coupled to the distal end of arm 106. Revolving member 103 includes an operator's cab 108 and the like.

<Hydraulic System>

Figure 2:
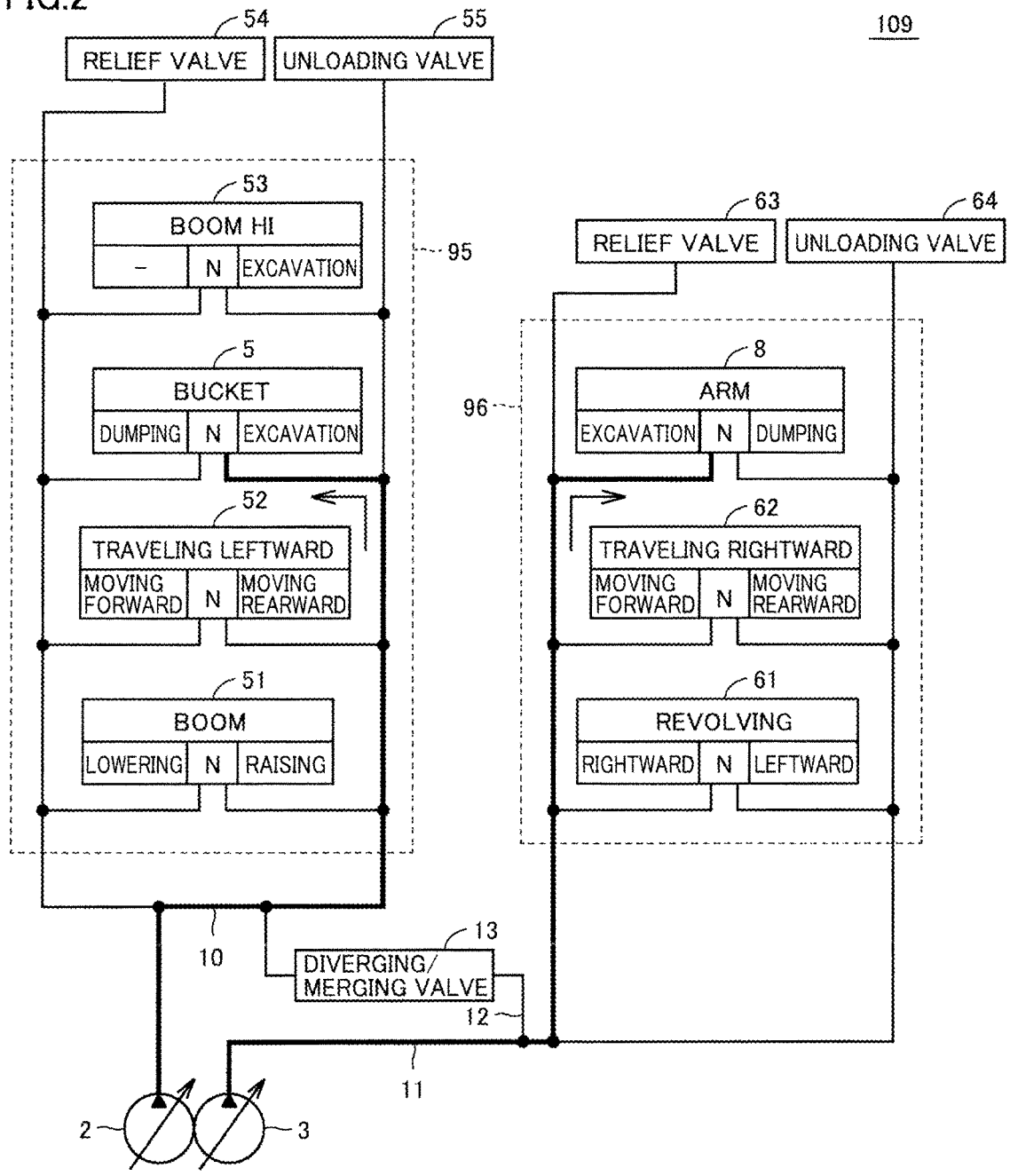
FIG. 2 is a diagram schematically illustrating a hydraulic system incorporated in the work vehicle.

FIG. 2 is a diagram schematically illustrating a hydraulic system 109 incorporated in work vehicle 100.

As illustrated in FIG. 2, hydraulic system 109 includes a first hydraulic pump 2, a second hydraulic pump 3, discharge hydraulic oil passages 10 and 11, and a communication passage 12. Hydraulic system 109 further includes a main operation valve 51 for the boom, a main operation valve 52 for the left crawler belt in traveling member 101, a main operation valve 5 for the bucket, a main operation valve 53 for the boom Hi (High), a main operation valve 61 for revolutions, a main operation valve 62 for the right crawler belt in traveling member 101, a main operation valve 8 for the arm, relief valves 54 and 63, unloading valves 55 and 64, and a diverging/merging valve 13. First hydraulic pump 2 is connected, at its discharging port, to inlet-side ports of main operation valves 5 and 51 to 53, through discharge hydraulic oil passage 10. First hydraulic pump 2 discharges a hydraulic oil to discharge hydraulic oil passage 10.

Second hydraulic pump 3 is connected, at its discharging port, to inlet-side ports of main operation valves 8, 61 and 62, through discharge hydraulic oil passage 11. Second hydraulic pump 3 discharges the hydraulic oil to discharge hydraulic oil passage 11.

Discharge hydraulic oil passage 10 and discharge hydraulic oil passage 11 are connected to each other through communication passage 12. Diverging/merging valve 13 is provided halfway through communication passage 12.

Diverging/merging valve 13 is switched between a merging position for causing discharge hydraulic oil passage 10 and discharge hydraulic oil passage 11 to communicate with each other, and a diverging position for separating discharge hydraulic oil passage 10 and discharge hydraulic oil passage 11 from each other. Further, hereinafter, the state where diverging/merging valve 13 is at the merging position so that discharge hydraulic oil passage 10 and discharge hydraulic oil passage 11 communicate with each other will be also referred to as a "merging state". Further, the state where diverging/merging valve 13 is at the diverging position so that discharge hydraulic oil passage 10 and discharge hydraulic oil passage 11 are separated from each other will be also referred to as a "diverging state".

Diverging/merging valve 13 is controlled such that it is at the diverging position, during low-load operations. Diverging/merging valve 13 is controlled such that it is at the merging position during high-load operations, except when a predetermined condition has been satisfied. For example, during hoisting revolutions, diverging/merging valve 13 is controlled such that it is at the merging position. The "predetermined condition" will be described later.

Main operation valve 53 for the boom Hi flows the hydraulic oil to a boom cylinder, which is not illustrated, when an operation lever for operating the boom has been operated by a largest amount. Thus, the hydraulic oil is supplied to the boom cylinder through main operation valve 51 for the boom and main operation valve 53 for the boom Hi, thereby driving boom 105.

Relief valves 54 and 63 are safety valves for controlling the hydraulic pressure, in such a way as to prevent the hydraulic pressure from rising to be equal to or higher than a set pressure. Unloading valves 55 and 64 are valves for causing the hydraulic pumps to perform no-load operations (unloading), when the hydraulic pressure has reached a defined pressure.

Figure 3:
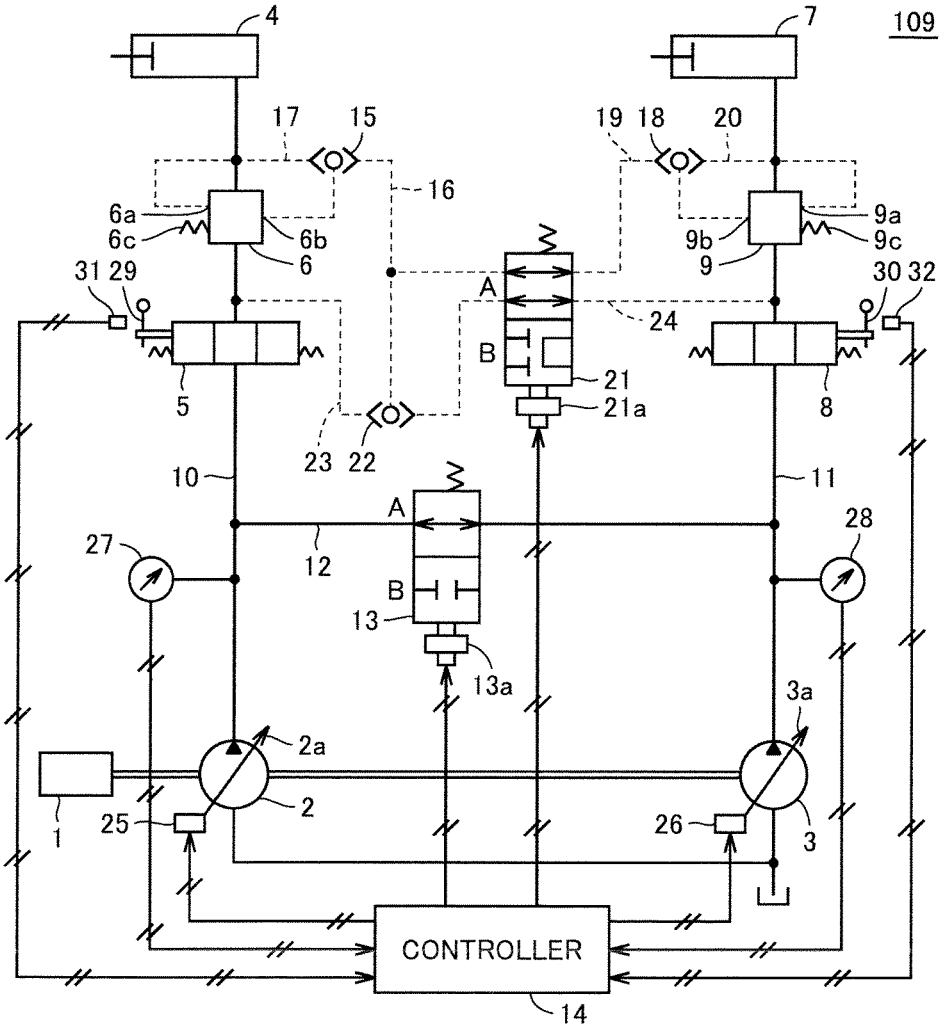
FIG. 3 is a diagram illustrating the hydraulic system in detail.

Hereinafter, for convenience of description, the hydraulic system including discharge hydraulic oil passage 10 and main operation valves 5 and 51 to 53 will be also referred to as a "first hydraulic system 95". Further, the hydraulic system including discharge hydraulic oil passage 11 and main operation valves 8, 61 and 62 will be also referred to as a "second hydraulic system 96", FIG. 3 is a diagram illustrating hydraulic system 109 in detail. Further, in FIG. 3, there are illustrated main operation valve 5 for the bucket, and main operation valve 8 for the arm, out of plural main operation valves 5, 8, 51 to 53, 61 and 62 illustrated in FIG. 2, in order to focus on compound operations for concurrently operating arm 106 and bucket 107 for performing excavation operations.

As illustrated in FIG. 3, hydraulic system 109 further includes an engine 1, a controller 14, servo mechanisms 25 and 26, pressure sensors 27 and 28, operation levers 29 and 30, amount-of-operation detection sensors 31 and 32, pressure compensation valves 6 and 9, a bucket cylinder 4, an arm cylinder 7, a diverging/merging valve 21, shuttle valves 15, 18 and 22, load-pressure introducing hydraulic oil passages 16, 19, 23 and 24, and holding-pressure introducing hydraulic oil passages 17 and 20, besides the members illustrated in FIG. 2.

Incidentally, bucket cylinder 4 is an example of "a first actuator". Further, arm cylinder 7 is an example of "a second actuator". Bucket 107 is an example of "a first load" that is driven by the first actuator. Arm 106 is an example of "a second load" that is driven by the second actuator.

First hydraulic pump 2 includes a swash plate 2*a*. Second hydraulic pump 3 includes a swash plate 3*a*.

Diverging/merging valve 13 includes an electromagnetic solenoid 13*a*.

Diverging/merging valve 21 includes an electromagnetic solenoid 21*a*.

Pressure compensation valve 6 includes a pressure receiving portion 6*a* that is supplied with a holding pressure in bucket cylinder 4, a pressure receiving portion 6*b* that is supplied with a pilot pressure in the outlet port side of shuttle valve 15, and a spring 6*c* provided in the same side as pressure receiving portion 6*a*.

Pressure compensation valve 9 includes a pressure receiving portion 9*a* that is supplied with a holding pressure in arm cylinder 7, a pressure receiving portion 9*b* that is supplied with a pilot pressure in the outlet port side of shuttle valve 18, and a spring 9*c* provided in the same side as pressure receiving portion 9*a*.

Hereinafter, there will be described connection states and operations of the respective members. Bucket cylinder 4 is an actuator for driving bucket 107. Bucket cylinder 4 is driven by first hydraulic pump 2. When diverging/merging valve 13 is at the merging position, bucket cylinder 4 is driven by first hydraulic pump 2 and second hydraulic pump 3.

Arm cylinder 7 is an actuator for driving arm 106. Arm cylinder 7 is driven by second hydraulic pump 3. When diverging/merging valve 13 is at the merging position, arm cylinder 7 is driven by first hydraulic pump 2 and second hydraulic pump 3.

First hydraulic pump 2 and second hydraulic pump 3 are driven by engine 1.

Swash plate 2*a* in first hydraulic pump 2 is driven by servo mechanism 25. Servo mechanism 25 moves swash plate 2*a* to an inclination position corresponding to a control signal from controller 14. Due to the change of the inclination position of swash plate 2*a*, the capacity of first hydraulic pump 2 is changed. This changes the amount of the hydraulic oil discharged from first hydraulic pump 2.

Swash plate 3*a* in second hydraulic pump 3 is driven by servo mechanism 26. Servo mechanism 26 is adapted to move swash plate 3*a* to an inclination position corresponding to a control signal from controller 14. Due to the change of the inclination position of swash plate 3*a*, the capacity of second hydraulic pump 3 is changed. This changes the amount of the hydraulic oil discharged from second hydraulic pump 3.

Main operation valve 5 is connected, at its outlet port, to an inlet-side port of pressure compensation valve 6. Pressure compensation valve 6 is connected, at its outlet-side port, to bucket cylinder 4. The hydraulic oil discharged from first hydraulic pump 2 is supplied to main operation valve 5 through discharge hydraulic oil passage 10. The hydraulic oil passed through main operation valve 5 is supplied to bucket cylinder 4 through pressure compensation valve 6.

Main operation valve 8 is connected, at its outlet port, to an inlet-side port of pressure compensation valve 9. Pressure compensation valve 9 is connected, at its outlet-side port, to arm cylinder 7. The hydraulic oil discharged from second hydraulic pump 3 is supplied to main operation valve 8 through discharge hydraulic oil passage H. The hydraulic oil passed through main operation valve 8 is supplied to arm cylinder 7 through pressure compensation valve 9.

When diverging/merging valve 13 is at the merging position, the hydraulic oil discharged from first hydraulic pump 2 is supplied to bucket cylinder 4 and arm cylinder 7 and, also, the hydraulic oil discharged from second hydraulic pump 3 is also supplied to bucket cylinder 4 and arm cylinder 7.

Main operation valve 5 is operated through operation lever 29 provided in the right side of operator's cab 108. When an operator operates operation lever 29, the hydraulic oil supplied from main operation valve 5 to bucket cylinder 4 is changed in direction and flow rate. Thus, bucket 107 is driven in a direction corresponding to this operation and at a speed corresponding to this operation.

Main operation valve 8 is operated through operation lever 30 provided in the left side of operator's cab 108. When the operator operates operation lever 30, the hydraulic oil supplied from main operation valve 8 to arm cylinder 7 is changed in direction and flow rate. Thus, arm 106 is driven in a direction corresponding to this operation and at a speed corresponding to this operation.

Diverging/merging valve 21 can be at a merging position or at a diverging position, similarly to diverging/merging valve 13. When it is at the merging position, load-pressure introducing hydraulic oil passage 16 and load-pressure introducing hydraulic oil passage 19 communicate with each other and, also, the hydraulic oil flows into one inlet-side port of shuttle valve 22 through load-pressure introducing hydraulic oil passage 24. When it is at the diverging position, load-pressure introducing hydraulic oil passage 16 and load-pressure introducing hydraulic oil passage 19 are separated from each other and, also, the hydraulic oil is not flowed into shuttle valve 22 through load-pressure introducing hydraulic oil passage 24.

Pressure sensor 27 detects the pressure of the hydraulic oil flowing through discharge hydraulic oil passage 10. The result of the detection by pressure sensor 27 is sent to controller 14. Pressure sensor 28 detects the pressure of the hydraulic oil flowing through discharge hydraulic oil passage 11. The result of the detection by pressure sensor 28 is sent to controller 14.

Amount-of-operation detection sensor 31 detects the amount by which operation lever 29 has been operated. The result of the detection by amount-of-operation detection sensor 31 is sent to controller 14.

Amount-of-operation detection sensor 32 detects the amount by which operation lever 30 has been operated. The result of the detection by amount-of-operation detection sensor 32 is sent to controller 14.

(Pressure Compensation by Pressure Compensation Valves 6 and 9)

Each pressure compensation valve 6, 9 is capable of changing the differential pressure between the inlet-side port and the outlet-side port of pressure compensation valve 6 or 9, by moving a spool within a sleeve.

Pressure compensation valve 6 compensates the differential pressure between the inlet-side port and the outlet-side port of main operation valve 5 (referred to as the "differential pressure across main operation valve 5", hereinafter) such that it is constant. Pressure compensation valve 9 compensates the differential pressure between the inlet-side port and the outlet-side port of main operation valve 8 (referred to as the "differential pressure across main operation valve 8", hereinafter) such that it is constant.

When diverging/merging valve 13 and diverging/merging valve 21 are at the merging positions, pressure compensation valves 6 and 9 perform operations as follows.

When the differential pressure across main operation valve 5 comes to be lower than the differential pressure across main operation valve 8, pressure compensation valve 6 moves the spool in such a direction as to increase the differential pressure between the inlet-side port and the outlet-side port of pressure compensation valve 6, in order to make the differential pressure between the inlet-side port of main operation valve 5 and the outlet-side port of pressure compensation valve 6 (also referred to as an "apparent differential pressure across main operation valve 5", hereinafter) be equal to the differential pressure across main operation valve 8.

When the differential pressure across main operation valve 8 comes to be lower than the differential pressure across main operation valve 5, pressure compensation valve 9 moves the spool in such a direction as to increase the differential pressure between the inlet-side port and the outlet-side port of pressure compensation valve 9, in order to make the differential pressure between the inlet-side port of main operation valve 8 and the outlet-side port of pressure compensation valve 9 (also referred to as an "apparent differential pressure across main operation valve 8", hereinafter) be equal to the differential pressure across main operation valve 5.

As described above, when diverging/merging valve 13 and diverging/merging valve 21 are at the merging positions, pressure compensation valves 6 and 9 perform pressure compensation over first hydraulic system 95 and second hydraulic system 96. More specifically, pressure compensation valves 6 and 9 perform pressure compensation, with respect to all the main operation valves included in first hydraulic system 95 and second hydraulic system 96.

On the other hand, when diverging/merging valve 13 and diverging/merging valve 21 are at the diverging positions, pressure compensation valve 6 does not perform the operation for making the apparent differential pressure across main operation valve 5 be equal to the differential pressure across main operation valve 8, even if the differential pressure across main operation valve 5 comes to be lower than the differential pressure across main operation valve 8. Further, pressure compensation valve 6 does not perform the operation for making the apparent differential pressure across main operation valve 5 be equal to the differential pressure across main operation valve 8, even if the differential pressure across main operation valve 8 comes to be lower than the differential pressure across main operation valve 5.

When diverging/merging valve 13 and diverging/merging valve 21 are at the diverging positions, pressure compensation valve 6 performs pressure compensation within first hydraulic system 95. Pressure compensation valve 9 performs pressure compensation within second hydraulic system 96.

There will be described in detail, based on operations of shuttle valves 15, 18 and 22, the pressure compensation when diverging/merging valve 13 and diverging/merging valve 21 are at the merging positions, as follows.

Shuttle valve 22 is connected, at one inlet-side port thereof, to the hydraulic oil passage between the outlet-side port of main operation valve 5 and the inlet-side port of pressure compensation valve 6, through load-pressure introducing hydraulic oil passage 23. Shuttle valve 22 is connected, at its other inlet-side port, to the hydraulic oil passage between the outlet-side port of main operation valve 8 and the inlet-side port of pressure compensation valve 9, through load-pressure introducing hydraulic oil passage 24 and diverging/merging valve 21.

Shuttle valve 22 is connected, at its outlet-side port, to one inlet-side port of shuttle valve 15 through load-pressure introducing hydraulic oil passage 16. Further, shuttle valve 22 is connected, at its outlet-side port, to one inlet-side port of shuttle valve 18, through load-pressure introducing hydraulic oil passage 19 and diverging/merging valve 21.

Shuttle valve 15 is connected, at its other inlet-side port, to pressure receiving portion 6*a* in pressure compensation valve 6. Further, the other inlet-side port of shuttle valve 15 is connected to the hydraulic oil passage between the outlet-side port of pressure compensation valve 6 and bucket cylinder 4. Shuttle valve 15 is connected, at its outlet-side port, to pressure receiving portion 6*b* in pressure compensation valve 6.

Shuttle valve 18 is connected, at its other inlet-side port, to pressure receiving portion 9*a* in pressure compensation valve 9. Further, the other inlet-side port of shuttle valve 18 is connected to the hydraulic oil passage between the outlet-side port of pressure compensation valve 9 and arm cylinder 7. Shuttle valve 18 is connected, at its outlet-side port, to pressure receiving portion 9*b* in pressure compensation valve 9.

Shuttle valve 22 detects a higher hydraulic pressure (also referred to as a "first highest load pressure", hereinafter), out of the hydraulic pressure at the outlet-side port of main operation valve 5 and the hydraulic pressure at the outlet-side port of main operation valve 8. Shuttle valve 22 outputs the first highest load pressure to load-pressure introducing hydraulic oil passages 16 and 19.

Shuttle valve 15 detects a higher hydraulic pressure (also referred to as a "second highest load pressure", hereinafter), out of the first highest load pressure and the hydraulic pressure at the outlet-side port of pressure compensation valve 6 (the holding pressure in bucket cylinder 4). Shuttle valve 15 outputs the second highest load pressure to pressure receiving portion 6*b*.

When the differential pressure across main operation valve 5 is lower than the differential pressure across main operation valve 8, shuttle valve 22 outputs the hydraulic pressure at the outlet-side port of main operation valve 8 to load-pressure introducing hydraulic oil passage 16. Shuttle valve 15 outputs the hydraulic pressure at the outlet-side port of main operation valve 8 to pressure receiving portion 6*b*. Thus, the apparent differential pressure across main operation valve 5 comes to be equal to the differential pressure across main operation valve 8.

When the differential pressure across main operation valve 8 is lower than the differential pressure across main operation valve 5, shuttle valve 22 outputs the hydraulic pressure at the outlet-side port of main operation valve 5 to load-pressure introducing hydraulic oil passage 19. Shuttle valve 18 outputs the hydraulic pressure at the outlet-side port of main operation valve 5 to pressure receiving portion 9*b*. Thus, the apparent differential pressure across main operation valve 8 comes to be equal to the differential pressure across main operation valve 5.

Further, pressure compensation valve 6 can be also incorporated in main operation valve 5, so that main operation valve 5 and pressure compensation valve 6 can be integrated. Similarly, pressure compensation valve 9 can be also incorporated in main operation valve 8, so that main operation valve 8 and pressure compensation valve 9 can be integrated.

(Content of Control by Controller 14)

Controller 14 controls the amount of the hydraulic oil discharged from first hydraulic pump 2, and the amount of the hydraulic oil discharged from second hydraulic pump 3. Controller 14 controls the amount of the hydraulic oil discharged from first hydraulic pump 2, by controlling the inclination position of swash plate 2*a*.

Controller 14 controls the amount of the hydraulic oil discharged from second hydraulic pump 3, by controlling the inclination position of swash plate 3*a*.

Controller 14 controls the operation of diverging/merging valve 13 and the operation of diverging/merging valve 21. Controller 14 outputs a control signal to the electromagnetic solenoid 13*a* to cause the state of diverging/merging valve 13 to switch between the aforementioned merging position and diverging position. Controller 14 outputs a control signal to electromagnetic solenoid 21*a* to cause the state of diverging/merging valve 21 to switch between the aforementioned merging position and diverging position.

Controller 14 controls the inclination position of swash plate 2*a*, the inclination position of swash plate 3*a*, the operation of diverging/merging valve 13 and the operation of diverging/merging valve 21, based on the result of detection by pressure sensor 27, the result of detection by pressure sensor 28, the result of detection by amount-of-operation detection sensor 31 and the result of detection by amount-of-operation detection sensor 32.

As will be described later in detail, controller 14 controls first hydraulic pump 2 and second hydraulic pump 3, such that the amount of the hydraulic oil discharged from first hydraulic pump 2 is larger than the amount of the hydraulic oil discharged from second hydraulic pump 3, when diverging/merging valve 13 is switched from the merging position to the diverging position.

Incidentally, main operation valve 5, discharge hydraulic oil passage 10, discharge hydraulic oil passage 11, bucket cylinder 4, arm cylinder 7, diverging/merging valve 13, pressure compensation valve 6, pressure sensor 27 and 28, and controller 14 are examples of "a first main operation valve", "a first hydraulic oil passage", "a Second hydraulic oil passage", "the first actuator", "the second actuator", "a diverging/merging valve", "a first pressure compensation valve", "a sensor", and "a controller", respectively.

(Switching Between Diverging Position and Merging Position)

As described above, diverging/merging valve 13 is controlled to be at the merging position, during high-load operations, except when the predetermined condition has been satisfied. "The predetermined condition" refers to a state where the pump pressure in first hydraulic pump 2 or the second hydraulic pump 3 has exceeded a predetermined threshold value, during excavation operations. When the predetermined condition is satisfied, as described above, work vehicle 100 switches diverging/merging valve 13 from the merging position to the diverging position. Hereinafter, the predetermined condition will be described in detail.

Further, hereinafter, it is assumed that controller 14 utilizes the pressure value of the hydraulic oil discharged from first hydraulic pump 2 (also referred to as the "pump pressure in first hydraulic pump 2", hereinafter), as an example. More specifically, it is assumed that controller 14 utilizes the result of detection by pressure sensor 27. Also, controller 14 may utilize the pressure value of the hydraulic oil discharged from second hydraulic pump 3, instead of the pressure value of the hydraulic oil discharged from first hydraulic pump 2.

Figure 4:
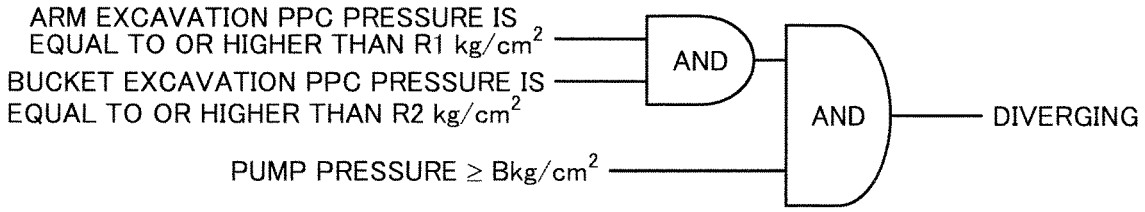
FIG. 4 is a diagram illustrating logic for switching from merging to diverging.

FIG. 4 is a diagram illustrating logic for switching from the merging position to the diverging position. As illustrated in FIG. 4, controller 14 determines whether or not the arm excavation PPC pressure (the pilot pressure) is equal to or higher than R1 kg/cm$^2$ (also referred to as a "first condition", hereinafter) and, also, the bucket excavation PPC pressure is equal to or higher than R2 kg/cm$^2$ (also referred to as a "second condition", hereinafter), in order to determine whether or not the work vehicle is performing an excavation operation. Further, R1 and R2 are threshold values (constant values).

Further, when the arm excavation PPC pressure is equal to or higher than R kg/cm$^2$ and, also, the bucket excavation PPC pressure is equal to or higher than R2 kg/cm$^2$ (when the first condition and the second condition are satisfied), controller 14 determines whether or not the pump pressure in first hydraulic pump 2 is equal to or higher than B kg/cm$^2$ (also referred to as a "third condition", hereinafter). Further, B is a threshold value (constant value).

When the first condition, the second condition, and the third condition are all satisfied, controller 14 causes diverging/merging valve 13 to switch from the merging position to the diverging position. Similarly, when the first condition, the second condition, and the third condition are satisfied, controller 14 causes diverging/merging valve 21 to switch from the merging position to the diverging position. Further, the aforementioned determination is set to be effective, when the work vehicle is not revolving.

Figure 5:
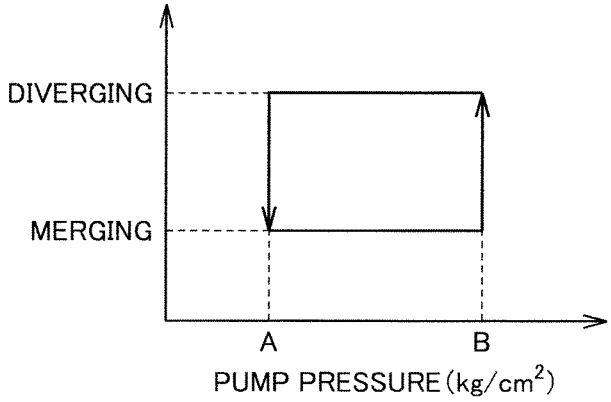
FIG. 5 is an explanatory diagram for describing a trigger for switching between a merging position and a diverging position during excavation operations.

FIG. 5 is an explanatory diagram for describing the trigger for switching between the merging position and the diverging position during excavation operations. As illustrated in FIG. 5, when the aforementioned first and second conditions have been satisfied, when the pump pressure in first hydraulic pump 2 comes to be equal to or higher than B kg/cm$^2$, controller 14 causes the states of diverging/merging valves 13 and 21 to switch from the merging positions to the diverging positions.

Thereafter, on condition that the aforementioned first and second conditions have been satisfied, when the pump pressure in first hydraulic pump 2 comes to be equal to or lower than A (<B) kg/cm$^2$, controller 14 causes the states of diverging/merging valves 13 and 21 to switch from the diverging positions to the merging positions. Further, A is a threshold value (constant value).

As described above, the pump pressure in first hydraulic pump 2 at the time of switching from the merging positions to the diverging positions is set to be higher than the pump pressure in first hydraulic pump 2 at the time of switching, again, from the diverging positions to the merging positions. The reason therefor will be described later.

Further, the pump pressure values "B kg/cm$^2$" and "A kg/cm$^2$" are examples of "a first predetermined value" and "a third predetermined value", respectively.

(Changing of Flow Rate Proportion)

Controller 14 controls first hydraulic pump 2 and second hydraulic pump 3, such that the amount of the hydraulic oil discharged from first hydraulic pump 2 is equal to the amount of the hydraulic oil discharged from second hydraulic pump 3, when diverging/merging valves 13 and 21 are at the merging positions.

When diverging/merging valves 13 and 21 are switched from the merging positions to the diverging positions, since the aforementioned three conditions have been satisfied, controller 14 controls first hydraulic pump 2 and second hydraulic pump 3, such that the amount of the hydraulic oil discharged from first hydraulic pump 2 is larger than the amount of the hydraulic oil discharged from second hydraulic pump 3. More specifically, controller 14 shifts the torque distribution at the diverging positions from an even state to a state where larger torque is absorbed by the bucket side than by the arm side. Hereinafter, this control will be described in detail.

Figure 6:
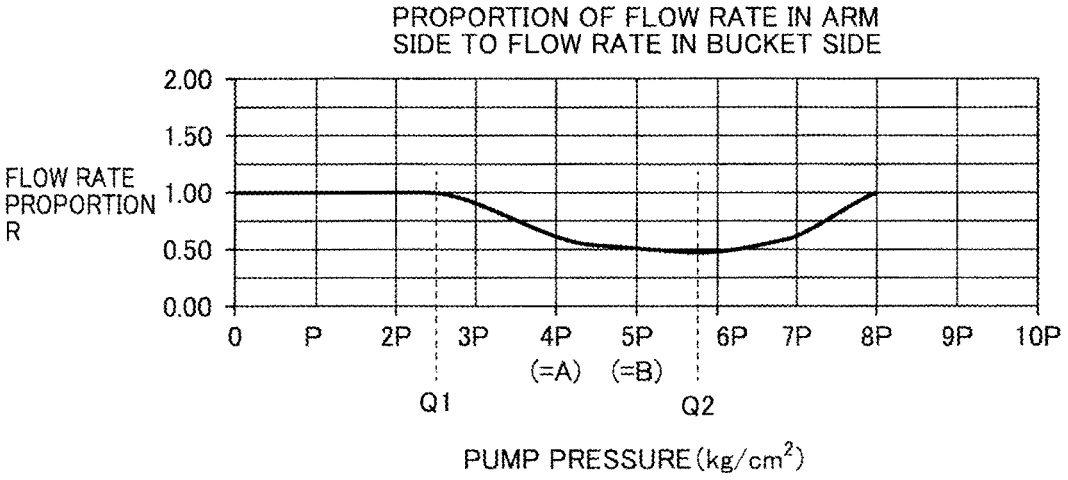
FIG. 6 is a diagram illustrating proportion of an amount of the hydraulic oil discharged from a second hydraulic pump to an amount of the hydraulic oil discharged from a first hydraulic pump.

FIG. 6 is a diagram illustrating the proportion of the amount of the hydraulic oil discharged from second hydraulic pump 3 to the amount of the hydraulic oil discharged from first hydraulic pump 2. The graph of FIG. 6 is utilized when diverging/merging valves 13 and 21 have been switched from the merging positions to the diverging positions, since the switching logic illustrated in FIG. 4 has been satisfied.

Further, the graph of FIG. 6 illustrates the proportion of the flow rate of the hydraulic oil supplied to the arm side to the flow rate of the hydraulic oil supplied to the bucket side. More specifically, since diverging/merging valve 13 is in the state of being at the diverging position, the graph of FIG. 6 illustrates the proportion of the flow rate of the hydraulic oil supplied to first hydraulic system 95 to the flow rate of the hydraulic oil supplied to second hydraulic system 96. Further, hereinafter, this proportion will be also referred to as a "flow rate proportion R".

The graph of FIG. 6 shows the flow rate in the arm side, assuming that the flow rate in the bucket side is "1". Referring to this graph, flow rate proportion R is less than 1, when the pump pressure in first hydraulic pump 2 is in the range of Q1 (2P<Q1<3P) kg/cm$^2$ to 8P kg/cm$^2$. Within this range, the amount of the hydraulic oil discharged from first hydraulic pump 2 is larger than the amount of the hydraulic oil discharged from second hydraulic pump 3. Incidentally, P is a constant value.

During excavation operations, switching from the merging positions to the diverging positions occurs when the pump pressure in first hydraulic pump 2 is equal to or higher than B (=5P) kg/cm$^2$. Further, the returning from the diverging positions to the merging positions occurs when the pump pressure in first hydraulic pump 2 is equal to or lower than A (=4P) kg/cm$^2$. Therefore, in actual, controller 14 utilizes flow rate proportion R in the region within which the pump pressure is equal to or higher than 4P kg/cm$^2$, in the graph of FIG. 6.

As indicated by flow rate proportion R in the aforementioned range, controller 14 controls first hydraulic pump 2 and second hydraulic pump 3, such that the amount of the hydraulic oil discharged from first hydraulic pump 2 is larger than the amount of the hydraulic oil discharged from second hydraulic pump 3, until diverging/merging valves 13 and 21 are switched from the diverging positions to the merging positions, after the states of diverging/merging valves 13 and 21 are switched to the diverging positions from the merging positions.

On the other hand, during an excavation operation, bucket 107 is rotated during the latter half of the operation and, therefore, the load on bucket 107 tends to be increased during the latter half of the operation. For coping therewith, it is possible to suppress the reduction of the speed of excavation by bucket 107, by making the amount of the hydraulic oil supplied from first hydraulic pump 2 to bucket cylinder 4 be larger than the amount of the hydraulic oil supplied from second hydraulic pump 3 to arm cylinder 7. Accordingly, with work vehicle 100, it is possible to perform excavation operations with higher efficiency.

After switching diverging/merging valves 13 and 21 from the merging positions to the diverging positions, controller 14 gradually reduces flow rate proportion R, as the value of the result of detection by pressure sensor 27 increases. More specifically, controller 14 gradually reduces flow rate proportion R, as the value of the result of detection by pressure sensor 27 increases, when the result of detection by pressure sensor 27 is in the range of 5P (=B) kg/cm$^2$ to Q2 kg/cm$^2$ (5P<Q2<6P). In other words, controller 14 increases the proportion of the amount of the hydraulic oil discharged from first hydraulic pump 2 to the amount of the hydraulic oil discharged from second hydraulic pump 3.

During excavation operations, as the load on bucket 107 is increased, the pump pressure in first hydraulic pump 2 is increased. For coping therewith, by reducing flow rate proportion R as the value of the result of detection by pressure sensor 27 increases, it is possible to suppress the reduction of the speed of excavation by bucket 107, even if the load on bucket 107 is gradually increased.

Incidentally, the pump pressure value "Q1 kg/cm$^2$" is an example of "the second predetermined value".

<Functional Structure>

Figure 7:
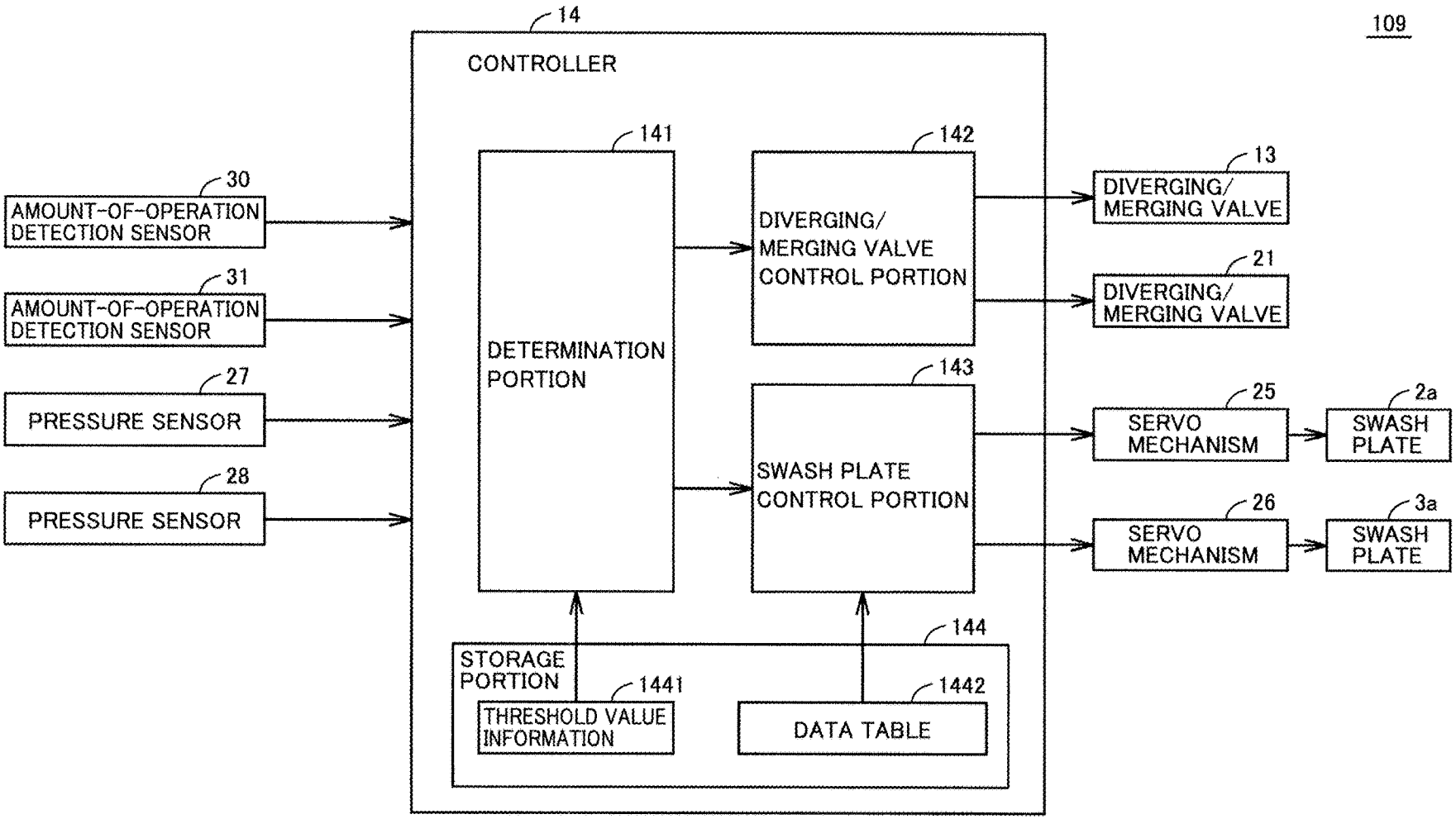
FIG. 7 is a block diagram illustrating a functional structure of the hydraulic system.

FIG. 7 is a block diagram illustrating the functional structure of hydraulic system 109.

As illustrated in FIG. 7, hydraulic system 109 includes controller 14, diverging/merging valves 13 and 21, pressure sensors 27 and 28, amount-of-operation detection sensors 31 and 32, servo mechanisms 25 and 26, and swash plates 2*a* and 3*a*.

Controller 14 includes a determination portion 141, a diverging/merging-valve control portion 142, a swash-plate control portion 143, and a storage portion 144. The storage portion 144 stores threshold-value information 1441, and data table 1442.

Threshold-value information 1441 includes the threshold value "R1 kg/cm$^2$" for the arm excavation PPC pressure, the threshold value "R2 kg/cm$^2$" for the bucket excavation PPC pressure, and the threshold value "B kg/cm$^2$" for the pump pressure in first hydraulic pump 2, which have been described regarding the switching logic in FIG. 4. Further, as threshold-value information 1441, there is stored the threshold value "A kg/cm$^2$" for the pump pressure in first hydraulic pump 2, which is used for switching from the diverging positions to the merging positions.

Data table 1442 is data indicating the graph of FIG. 6. In the data table, there are stored pump pressures and flow rate proportions R, in association with each other.

Determination portion 141 determines whether or not the switching logic illustrated in FIG. 4 has been satisfied, based on the results of detections by pressure sensors 27 and 28, the results of detections by amount-of-operation detection sensors 31 and 32, and threshold-value information 1441. If determination portion 141 determines that the switching logic has been satisfied (if it determines that switching from the merging positions to the diverging positions should be performed), determination portion 141 sends commands to diverging/merging-valve control portion 142 and swash-plate control portion 143.

On receiving the command from determination portion 141, diverging/merging-valve control portion 142 switches diverging/merging valves 13 and 21 from the merging positions to the diverging positions.

Swash-plate control portion 143 causes serve mechanism 25 to control the inclination position of swash plate 2*a* and also causes serve mechanism 26 to control the inclination position of swash plate 3*a*, such that the amount of the hydraulic oil discharged from first hydraulic pump 2 is larger than the amount of the hydraulic oil discharged from second hydraulic pump 3, by referring to data table 1442.

<Control Structure>

Figure 8:
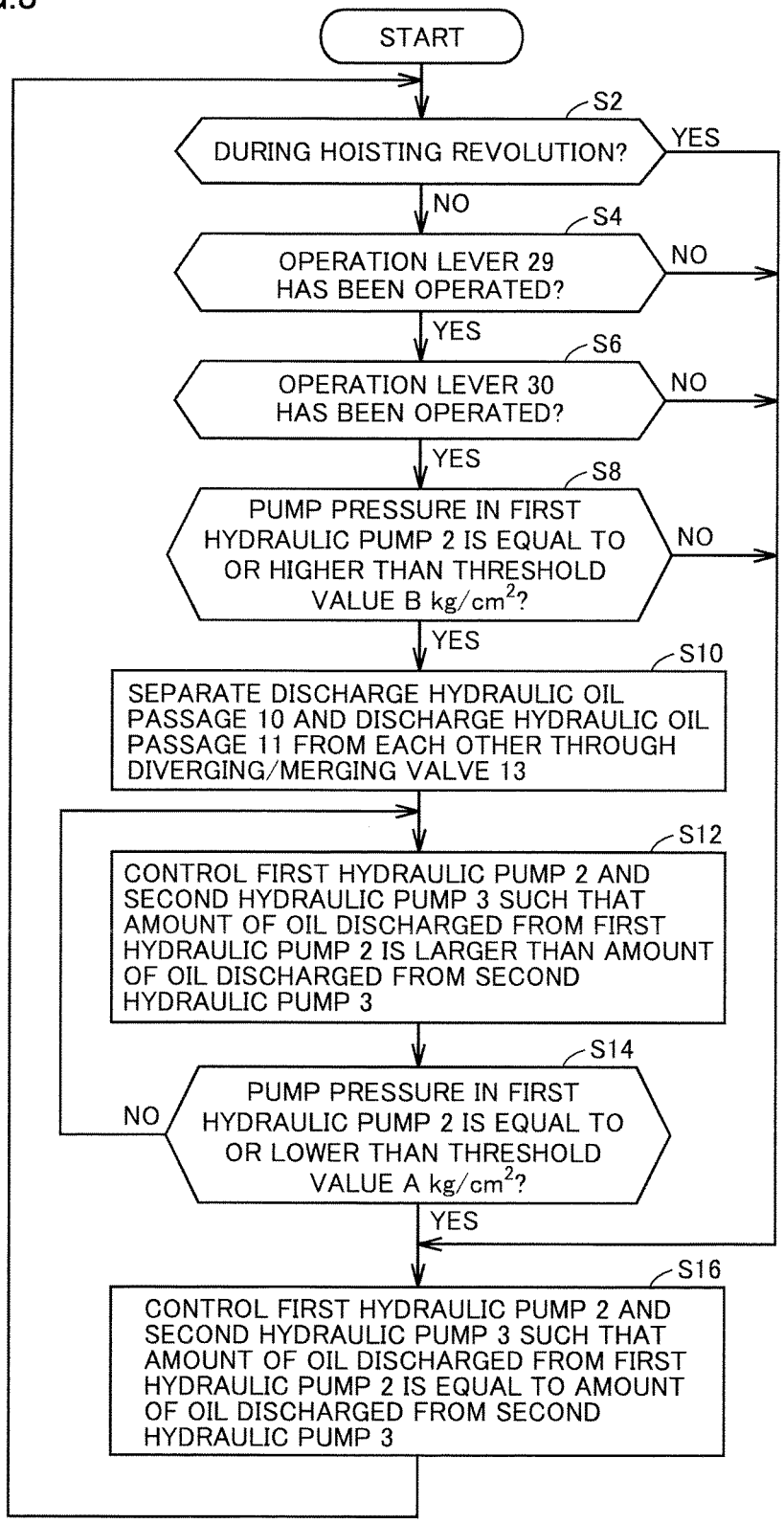
FIG. 8 is a flowchart illustrating a flow of processing for hydraulic control in the hydraulic system.

FIG. 8 is a flowchart illustrating the flow of processing for hydraulic control in hydraulic system 109.

As illustrated in FIG. 8, in step S2, controller 14 determines whether or not the work vehicle is performing hoisting revolution. If it is determined that the work vehicle is not performing hoisting revolution (NO in step S2), controller 14 determines whether or not operation lever 29 has been operated in step S4. More specifically, controller 14 determines whether or not the bucket excavation PPC pressure has come to be equal to or higher than R2/cm$^2$. If it is determined that the work vehicle is performing hoisting revolution (YES in step S2), the processing proceeds to step S16.

If it is determined that operation lever 29 has not been operated (NO in step S4), controller 14 advances the processing to step S16. If it is determined that operation lever 29 has been operated (YES in step S4), controller 14 determines whether or not operation lever 30 has been operated in step S6. More specifically, controller 14 determines whether or not the arm excavation PPC pressure has come to be equal to or higher than R1 kg/cm$^2$.

If it is determined that operation lever 30 has not been operated (NO in step S8), controller 14 advances the processing to step S16. If it is determined that operation lever 30 has been operated (YES in step S8), controller 14 separates discharge hydraulic oil passage 10 and discharge hydraulic oil passage 11 from each other through diverging/merging valve 13 in step S10. More specifically, controller 14 causes diverging/merging valves 13 and 21 to switch from the merging positions to the diverging positions.

In step S12, controller 14 controls first hydraulic pump 2 and second hydraulic pump 3, such that the amount of the hydraulic oil discharged from first hydraulic pump 2 is larger than the amount of the hydraulic oil discharged from second hydraulic pump 3. In step S14, controller 14 determines whether or not the pump pressure in first hydraulic pump 2 has come to be equal to or lower than A (=4P) kg/cm$^2$.

If it is determined that the pump pressure in first hydraulic pump 2 has come to be equal to or lower than A kg/cm$^2$ (YES in step S14), the processing proceeds to step S16. If it is determined that the pump pressure in first hydraulic pump 2 has not come to be equal to or lower than A kg/cm$^2$ (NO in step S14), controller 14 advances the processing to step S12.

In step S16, controller 14 controls first hydraulic pump 2 and second hydraulic pump 3, such that the amount of the hydraulic oil discharged from first hydraulic pump 2 is equal to the amount of the hydraulic oil discharged from second hydraulic pump 3.

<Summary>

The structure of work vehicle 100 according to the present embodiment and the advantages provided by this structure will be summarized as follows.

(1) Work vehicle 100 includes bucket 107, arm 106, first hydraulic pump 2 and the second hydraulic pump 3 each for discharging the hydraulic oil, discharge hydraulic oil passage 10 through which the hydraulic oil discharged from first hydraulic pump 2 flows to drive bucket 107, discharge hydraulic oil passage 11 through which the hydraulic oil discharged from second hydraulic pump 3 flows to drive arm 106, diverging/merging valve 13 for switching between the merging position for causing discharge hydraulic oil passage 10 and discharge hydraulic oil passage 11 to communicate with each other, and the diverging position for separating discharge hydraulic oil passage 10 and discharge hydraulic oil passage 11 from each other, and controller 14 for controlling the amount of the hydraulic oil discharged from first hydraulic pump 2, the amount of the hydraulic oil discharged from second hydraulic pump 3, and the operation of diverging/merging valve 13. When one of the pump pressure in first hydraulic pump 2 and the pump pressure in second hydraulic pump 3 comes to be equal to or higher than B (=5P) kg/cm$^2$ during excavation operations, controller 14 causes diverging/merging valve 13 to switch from the merging position to the diverging position. After shifting diverging/merging valve 13 from the merging position to the diverging position, controller 14 controls first hydraulic pump 2 and second hydraulic pump 3, such that the amount of the hydraulic oil discharged from first hydraulic pump 2 is larger than the amount of the hydraulic oil discharged from second hydraulic pump 3.

With this structure, if one of the pump pressure in first hydraulic pump 2 and the pump pressure in second hydraulic pump 3 comes to be equal to or higher than B kg/cm$^2$ during excavation operations, discharge hydraulic oil passage 10 and discharge hydraulic oil passage 11 are brought into the state of being separated from each other. Further, when the pump pressure in first hydraulic pump 2 is equal to or higher than B kg/cm$^2$, the amount of the hydraulic oil discharged from first hydraulic pump 2 is larger than the amount of the hydraulic oil discharged from second hydraulic pump 3.

Therefore, the amount of the oil supplied to the side of bucket 107 is larger than the amount of the oil supplied to the arm side. This can suppress the reduction of the speed of excavation by bucket 107. This enables efficiently performing excavation operations, in comparison with structures adapted to make the amount of the oil supplied to the bucket side be equal to the amount of the oil supplied to the arm side.

(2) Controller 14 controls first hydraulic pump 2 and second hydraulic pump 3, such that the amount of the hydraulic oil discharged from first hydraulic pump 2 is larger than the amount of the hydraulic oil discharged from second hydraulic pump 3, when one of the pump pressure in first hydraulic pump 2 and the pump pressure in second hydraulic pump 3 is equal to or higher than Q1 kg/cm$^2$, that is smaller than B (=5P) kg/cm$^2$. With this structure, it is possible to suppress the reduction of the speed of excavation by bucket 107, when the pump pressure in first hydraulic pump 2 or the pump pressure in second hydraulic pump 3 is equal to or higher than Q1 kg/cm$^2$ that is smaller than B kg/cm$^2$.

(3) Work vehicle 100 further includes pressure sensor 27 for detecting the pump pressure in first hydraulic pump 2. Controller 14 gradually reduces the proportion of the amount of the hydraulic oil discharged from first hydraulic pump 2 to the amount of the hydraulic oil discharged from second hydraulic pump 3, as the value of the result of detection by pressure sensor 27 increases.

With this structure, the pump pressure increases as the load on the bucket side is increased. Therefore, by gradually increasing the proportion of the amount of the hydraulic oil discharged from first hydraulic pump 2 to the amount of the hydraulic oil discharged from second hydraulic pump 3 (the inverse number of flow rate proportion R) as the value of the result of detection by pressure sensor 27 increases, it is possible to suppress the reduction of the speed of excavation by bucket 107, even if the load on the bucket side is gradually increased.

(4) Controller 14 causes diverging/merging valve 13 to switch from the diverging position to the merging position, when one of the pump pressure in first hydraulic pump 2 and the pump pressure in second hydraulic pump 3 comes to be equal to or lower than A kg/cm$^2$, after diverging/merging valve 13 is switched from the merging position to the diverging position.

With this structure, after returning from the diverging position to the merging position, in order to cause the shift from the merging position to the diverging position, again, there is a need for an increase of the pump pressure by the difference between B and A ((B-A) kg/cm$^2$) Therefore, after returning from the diverging position to the merging position, it is possible to prevent immediate returning to the diverging position. By setting the hysteresis as described above, it is possible to prevent so-called clattering at the time of switching.

(5) Controller 14 controls first hydraulic pump 2 and second hydraulic pump 3, such that the amount of the hydraulic oil discharged from first hydraulic pump 2 is larger than the amount of the hydraulic oil discharged from second hydraulic pump 3, until the state of diverging/merging valve 13 is switched from the diverging position to the merging position, after diverging/merging valve 13 is shifted from the merging position to the diverging position.

With this structure, when discharge hydraulic oil passage 10 and discharge hydraulic oil passage 11 are separated from each other (during the diverging state), the amount of the oil supplied to the bucket side can be made larger than the amount of the oil supplied to the arm side. Particularly, until just before switching to the merging position (just before the hydraulic system is brought into the merging state), the amount of the oil supplied to the bucket side can be made larger than the amount of the oil supplied to the arm side.

<Modification>

Hydraulic system 109 has been described by exemplifying the structure of a CLSS (Closed center Load Sensing System), but hydraulic system 109 is not limited thereto. The structure adapted to control first hydraulic pump 2 and second hydraulic pump 3, such that the amount of the hydraulic oil discharged from first hydraulic pump 2 is larger than the amount of the hydraulic oil discharged from second hydraulic pump 3, in the state where the two hydraulic systems are diverged from each other can be also applied to OLSSs (Open center Load Sensing Systems) that do not necessitate pressure compensation valves 6 and 9.

Second Embodiment

In the present embodiment, similarly, a controller 14 utilizes switching logic (FIG. 4) similar to that of the first embodiment, and a trigger for switching between a merging position and a diverging position (FIG. 5). Further, controller 14 executes processing for changing a flow-rate proportion (FIG. 6), based on the switching logic and the trigger. Hereinafter, the description will be given by focusing on different structures from those of the first embodiment, and the same structures as those of the first embodiment will not be described redundantly.

<Hydraulic System>

Figure 9:
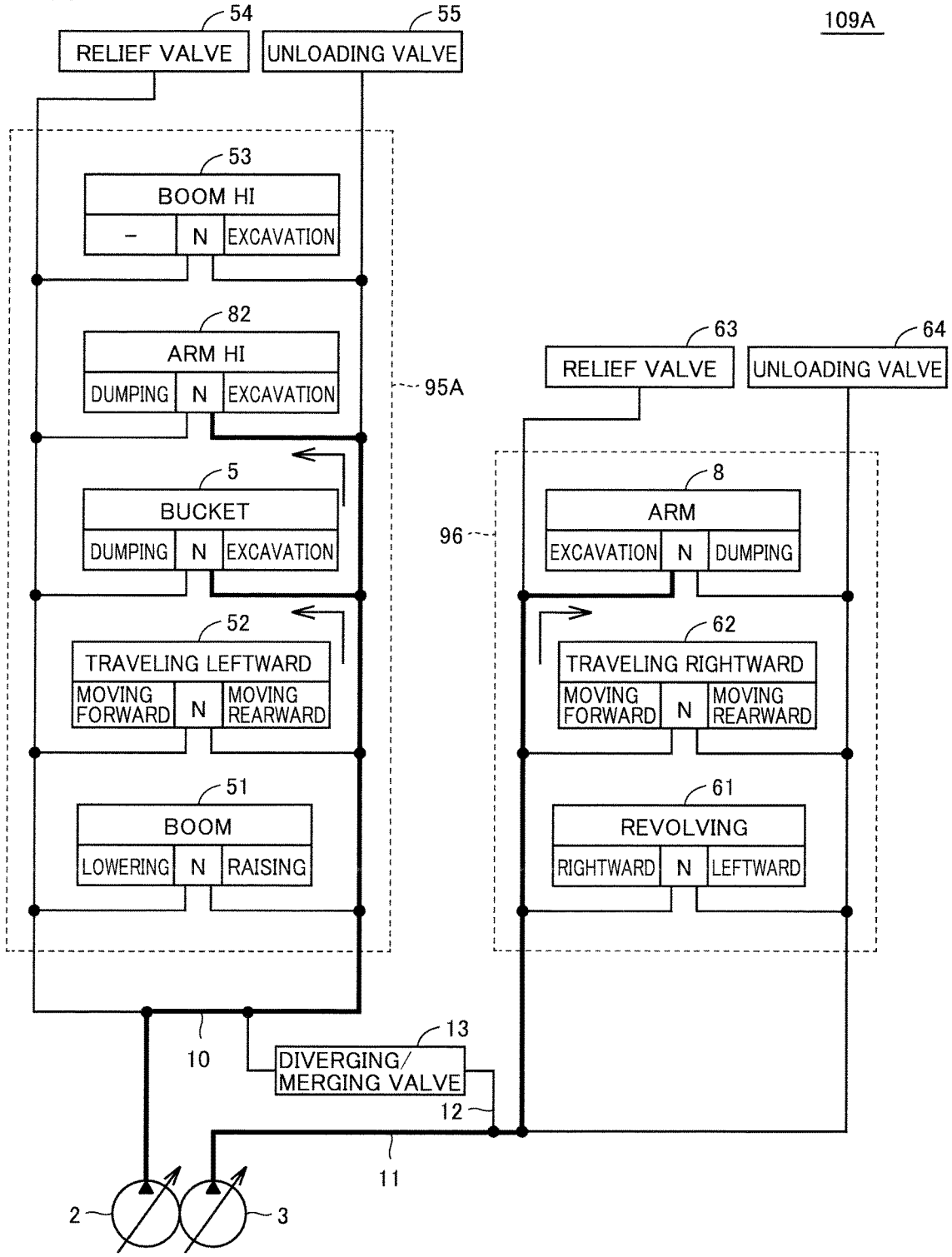
FIG. 9 is a diagram illustrating a general outline of a hydraulic system.

FIG. 9 is a diagram illustrating a general outline of a hydraulic system 109A according to the present embodiment.

As illustrated in FIG. 9, hydraulic system 109A includes a first hydraulic pump 2, a second hydraulic pump 3, discharge hydraulic oil passages 10 and 11, and a communication passage 12. Hydraulic system 109 further includes a main operation valve 51 for a boom, a main operation valve 52 for a left crawler belt in a traveling member 101, a main operation valve 5 for a bucket, a main operation valve 82 for an arm Hi, a main operation valve 53 for the boom Hi (High), a main operation valve 61 for revolutions, a main operation valve 62 for a right crawler belt in traveling member 101, a main operation valve 8 for the arm, relief valves 54 and 63, unloading valves 55 and 64, and a diverging/merging valve 13.

As described above, hydraulic system 109A according to the present embodiment is different from hydraulic system 109 according to the first embodiment, in that it includes main operation valve 82 for the arm Hi.

Main operation valve 53 for the arm Hi flows a hydraulic oil to an arm cylinder 7, when a operation lever 30 for manipulating the arm has been operated by a largest amount. Thus, the hydraulic oil is supplied to arm cylinder 7 through main operation valve 8 for the arm and main operation valve 82 for the arm Hi, thereby driving arm 106.

Hereinafter, for convenience of description, the hydraulic system including discharge hydraulic oil passage 10 and main operation valves 5, 51 to 53 and 82 will be also referred to as a "first hydraulic system 95A". Further, the hydraulic system including discharge hydraulic oil passage 11 and main operation valves 8, 61 and 62 will be also referred to as a "second hydraulic system 96".

Figure 10:
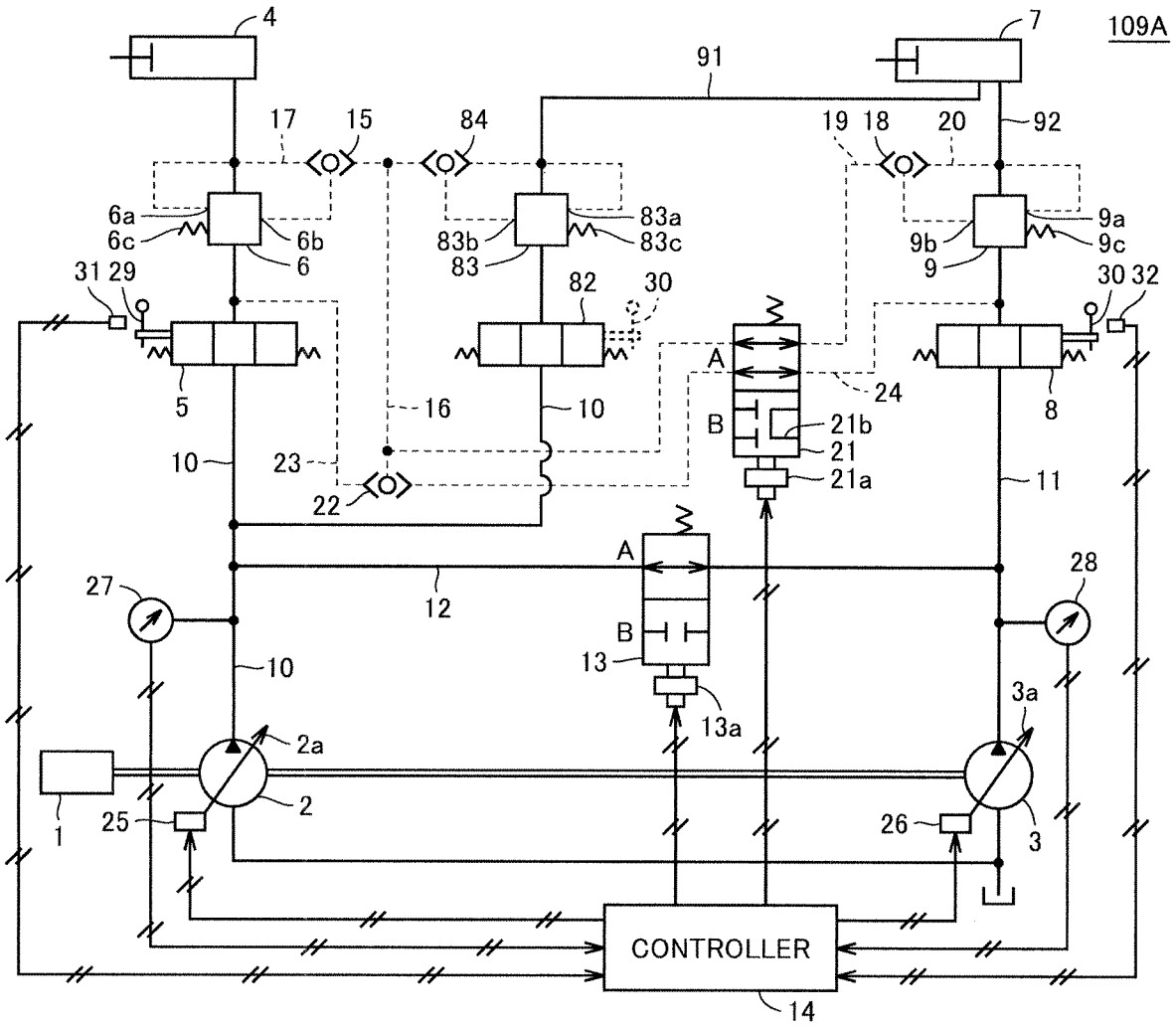
FIG. 10 is a diagram illustrating the hydraulic system in detail.

FIG. 10 is a diagram illustrating hydraulic system 109A in detail. Further, in FIG. 10, there are illustrated main operation valve 5 for the bucket, main operation valve 8 for the arm, and main operation valve 82 for the arm Hi, out of plural main operation valves 5, 8, 51 to 53, 61, 62 and 82 illustrated in FIG. 8, in order to focus on compound operations for concurrently manipulating arm 106 and bucket 107 for performing excavation operations.

As illustrated in FIG. 10, hydraulic system 109A further includes an engine 1, a controller 14, servo mechanisms 25 and 26, pressure sensors 27 and 28, operation levers 29 and 30, amount-of-operation detection sensors 31 and 32, pressure compensation valves 6, 9 and 83, a bucket cylinder 4, an arm cylinder 7, a diverging/merging valve 21, shuttle valves 15, 18, 22 and 84, load-pressure introducing hydraulic oil passages 16, 19, 23 and 24, and holding-pressure introducing hydraulic oil passages 17 and 20, besides the members illustrated in FIG. 9.

Hydraulic system 109A is different in that it includes main operation valve 82, pressure compensation valve 83, and shuttle valve 84, from hydraulic system 109 (see FIG. 3), of the first embodiment, that does not include them.

Main operation valve 82 is connected, at its inlet-side port, to first hydraulic pump 2, through discharge hydraulic oil passage 10. Main operation valve 82 is connected, at its outlet-side port, to an inlet-side port of pressure compensation valve 83. Pressure compensation valve 83 is connected, at its outlet-side port, to arm cylinder 7. The hydraulic oil discharged from first hydraulic pump 2 is supplied to main operation valves 5 and 82, through discharge hydraulic oil passage 10. The hydraulic oil passed through main operation valve 82 is supplied to arm cylinder 7, through pressure compensation valve 83.

Main operation valve 82 is operated through operation lever 30, similarly to main operation valve 8. On condition that operation lever 30 has been operated by a largest amount, the hydraulic oil is supplied from main operation valve 82 to arm cylinder 7.

Pressure compensation valve 83 includes a pressure receiving portion 83*a* that is supplied with a holding pressure in arm cylinder 7, a pressure receiving portion 83*b* that is supplied with a pilot pressure in the outlet-port side of shuttle valve 84, and a spring 83*c* provided in the same side as pressure receiving portion 83*a*.

When diverging/merging valve 13 is at the merging position, the hydraulic oil discharged from first hydraulic pump 2 is supplied to bucket cylinder 4 and arm cylinder 7 and, also, the hydraulic oil discharged from second hydraulic pump 3 is also supplied to bucket cylinder 4 and arm cylinder 7.

When diverging/merging valve 13 is at the diverging position, the hydraulic oil discharged from first hydraulic pump 2 is supplied to bucket cylinder 4 and, also, the hydraulic oil discharged from second hydraulic pump 3 is supplied to arm cylinder 7.

When operation lever 30 has been operated by a largest amount, at the merging position and the diverging position, the hydraulic oil discharged from first hydraulic pump 2 is supplied to arm cylinder 7, through discharge hydraulic oil passage 10, main operation valve 82, and pressure compensation valve 83.

Further, pressure compensation valve 83 is connected to arm cylinder 7, through a hydraulic oil passage 91. Pressure compensation valve 9 is connected to arm cylinder 7, through a hydraulic oil passage 92.

Figure 11:
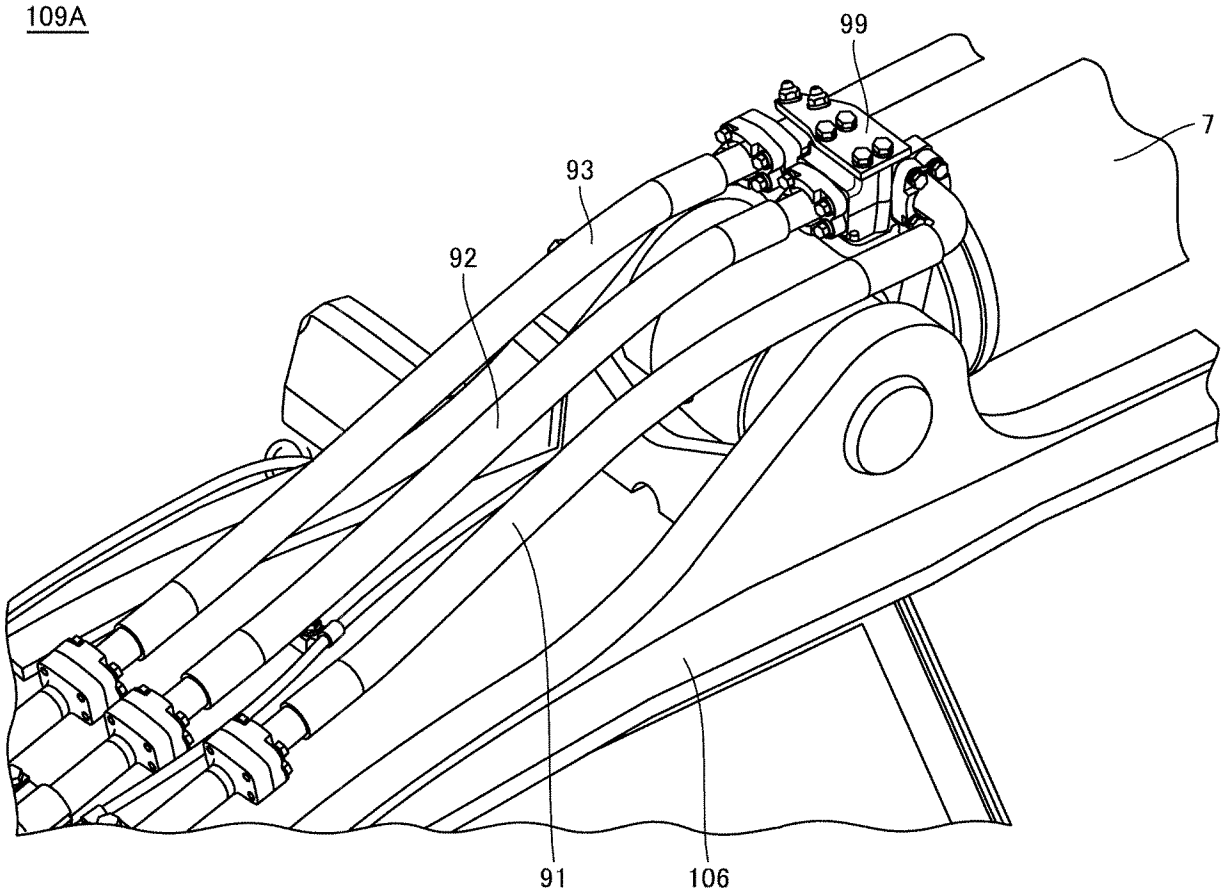
FIG. 11 is a main-part enlarged view of the hydraulic system.

FIG. 11 is a main-part enlarged view of hydraulic system 109A.

Referring to FIG. 11, the hydraulic oil passed through pressure compensation valve 83 is supplied to arm cylinder 7, through hydraulic oil passage 91, and through a merging block 99 at the bottom portion of arm cylinder 7. The hydraulic oil passed through pressure compensation valve 9 is supplied to arm cylinder 7, through hydraulic oil passage 92 and merging block 99. The hydraulic oil supplied to arm cylinder 7 is returned to a hydraulic oil tank, which is not illustrated, through hydraulic oil passage 93.

(Pressure Compensation by Pressure Compensation Valves 6, 9, and 83)

The pressure compensation according to the present embodiment will be described, with reference to FIG. 10, again.

Pressure compensation valve 83 is capable of changing the differential pressure between the inlet-side port and the outlet-side port of pressure compensation valve 83, by moving a spool within a sleeve, similarly to pressure compensation valves 6 and 9. Pressure compensation valve 83 compensates the differential pressure between the inlet-side port and the outlet-side port of main operation valve 82 (referred to as the "differential pressure across main operation valve 82", hereinafter) such that it is constant. Further, pressure compensation valve 83 can be also incorporated in main operation valve 82 so that main operation valve 82 and pressure compensation valve 83 can be integrated with each other.

When diverging/merging valve 13 and diverging/merging valve 21 are at the merging positions, pressure compensation valves 6, 9, and 83 perform operations as follows.

In focusing on pressure compensation valve 6 and pressure compensation valve 83, if the differential pressure across main operation valve 82 comes to be lower than the differential pressure across main operation valve 5, pressure compensation valve 83 moves the spool in such a direction as to increase the differential pressure between the inlet-side port and the outlet-side port of pressure compensation valve 83, in order to make the differential pressure between the inlet-side port of main operation valve 82 and the outlet-side port of pressure compensation valve 83 (also referred to as an "apparent differential pressure across main operation valve 82", hereinafter) be equal to the differential pressure across main operation valve 5.

On the other hand, if the differential pressure across main operation valve 5 comes to be lower than the differential pressure across main operation valve 82, pressure compensation valve 6 does not perform the operation for moving the spool in such a direction as to increase the differential pressure between the inlet-side port and the outlet-side port of pressure compensation valve 6. Therefore, the differential pressure between the inlet-side port of main operation valve 5 and the outlet-side port of pressure compensation valve 6 (an apparent differential pressure across main operation valve 5) does not come to be equal to the differential pressure across main operation valve 82.

In focusing on pressure compensation valve 9 and pressure compensation valve 83, if the differential pressure across main operation valve 82 comes to be lower than the differential pressure across main operation valve 8, pressure compensation valve 83 moves the spool, in order to make the apparent differential pressure across main operation valve 82 be equal to the differential pressure across main operation valve 8.

On the other hand, if the differential pressure across main operation valve 8 comes to be lower than the differential pressure across main operation valve 82, pressure compensation valve 9 does not perform an operation for moving the spool. Therefore, the apparent differential pressure across main operation valve 8 does not come to be equal to the differential pressure across main operation valve 82.

Further, the processing in focusing on pressure compensation valve 6 and pressure compensation valve 9 has been described in the first embodiment and, therefore, is not described herein redundantly.

As described above, at the merging positions, pressure compensation valves 6 and 9 perform pressure compensation over first hydraulic system 95A and second hydraulic system 96. More specifically, pressure compensation valves 6 and 9 perform pressure compensation, with respect to all the main operation valves included in first hydraulic system 95A and second hydraulic system 96. However, pressure compensation valve 83 performs no pressure compensation for the main operation valves other than main operation valve 82.

When diverging/merging valve 13 and diverging/merging valve 21 are at the diverging positions, pressure compensation valves 6, 9, and 83 perform operations as follows.

In focusing on pressure compensation valve 6 and pressure compensation valve 83, if the differential pressure across main operation valve 82 comes to be lower than the differential pressure across main operation valve 5, pressure compensation valve 83 makes the apparent differential pressure across main operation valve 82 be equal to the differential pressure across main operation valve 5, similarly to in the case of the merging positions.

On the other hand, if the differential pressure across main operation valve 5 comes to be lower than the differential pressure across main operation valve 82, pressure compensation valve 6 does not perform the operation for moving the spool, in such a direction as to increase the differential pressure between the inlet-side port and the outlet-side port of pressure compensation valve 6, similarly to in the case of the merging positions. Therefore, the apparent different pressure across main operation valve 5 does not come to be equal to the differential pressure across main operation valve 82.

When diverging/merging valve 13 and diverging/merging valve 21 are at the diverging positions, pressure compensation valve 6 performs pressure compensation within first hydraulic system 95. Pressure compensation valve 9 performs pressure compensation within second hydraulic system 96. Thus, at the diverging positions, no pressure compensation is performed between first hydraulic system 95A and second hydraulic system 96. Therefore, even if the differential pressure across main operation valve 82 comes to be lower than the differential pressure across main operation valve 8, no operation is performed for making the apparent differential pressure across main operation valve 82 be equal to the differential pressure across main operation valve 8.

There will be described pressure compensation when diverging/merging valve 13 and diverging/merging valve 21 are at the diverging positions, in focusing on shuttle valves 15, 22, and 84, as follows.

Shuttle valve 22 is connected, at its outlet-side port, to one inlet-side port of shuttle valve 15 and to one inlet-side port of shuttle valve 84, through load-pressure introducing hydraulic oil passage 16. Shuttle valve 84 is connected, at its other inlet-side port, to pressure receiving portion 83*a* in pressure compensation valve 83. Shuttle valve 84 is connected, at its outlet-side port, to pressure receiving portion 83*b* in pressure compensation valve 83.

Shuttle valve 22 is not connected, at its inlet-side port, to the outlet-side port of main operation valve 82. Further, shuttle valve 22 does not detect the hydraulic pressure at the outlet-side port of main operation valve 8, at the diverging positions. Therefore, shuttle valve 22 detects the hydraulic pressure at the outlet-side port of main operation valve 5, as a first highest load pressure. Shuttle valve 22 outputs the first highest load pressure to load-pressure introducing hydraulic oil passages 16 and 19.

Shuttle valve 15 detects a higher hydraulic pressure (a second highest load pressure), out of the first highest load pressure and the hydraulic pressure at the outlet-side port of pressure compensation valve 6 (the holding pressure in bucket cylinder 4), as described above. Shuttle valve 15 outputs the second highest load pressure to pressure receiving portion 6*b*.

Shuttle valve 84 detects a higher hydraulic pressure (referred to as a "third highest load pressure", hereinafter), out of the first highest load pressure and the hydraulic pressure at the outlet-side port of pressure compensation valve 83 (the holding pressure in arm cylinder 7). Shuttle valve 84 outputs the third highest load pressure to pressure receiving portion 83*b*.

When the differential pressure across main operation valve 82 is lower than the differential pressure across main operation valve 5, shuttle valve 84 outputs the hydraulic pressure at the outlet-side port of main operation valve 5 to pressure receiving portion 83*b*. Thus, the apparent differential pressure across main operation valve 82 comes to be equal to the differential pressure across main operation valve 5.

Therefore, the hydraulic oil discharged from first hydraulic pump 2 is less prone to be supplied to arm cylinder 7, in comparison with cases of not performing pressure compensation. Accordingly, it is possible to increase the speed of excavation by bucket 107, in comparison with cases of not performing pressure compensation.

When the differential pressure across main operation valve 5 is lower than the differential pressure across main operation valve 82, shuttle valve 15 outputs the hydraulic pressure at the outlet-side port of main operation valve 5 to pressure receiving portion 6*b*. Therefore, the apparent differential pressure across main operation valve 5 does not come to be equal to the differential pressure across main operation valve 82. With this structure, at the diverging positions, even if the differential pressure across main operation valve 82 comes to be higher than the differential pressure across main operation valve 5, no compensation is performed for main operation valve 5 and, therefore, the apparent differential pressure across main operation valve 5 is not increased.

Therefore, the hydraulic oil discharged from first hydraulic pump 2 is more prone to be supplied to bucket cylinder 4 than to arm cylinder 7. Accordingly, it is possible to increase the speed of excavation by bucket 107, in comparison with structures adapted to increase the apparent differential pressure across main operation valve 5 when the differential pressure across main operation valve 5 comes to be lower than the differential pressure across main operation valve 82 (structures adapted to perform compensation).

On the other hand, hydraulic system 109A switches diverging/merging valves 13 and 21 from the merging positions to the diverging positions and, also, makes the amount of the hydraulic oil discharged from first hydraulic pump 2 be larger than the amount of the hydraulic oil discharged from second hydraulic pump 3, when the pump pressure comes to be equal to or higher than B kg/cm$^2$ during excavation operations. By supplying a larger amount of the hydraulic oil to bucket cylinder 4 in this way, it is possible to suppress the reduction of the speed of excavation by bucket 107.

With this structure, in view of supplying a larger amount of the hydraulic oil to bucket cylinder 4, it is not preferable that the apparent differential pressure across main operation valve 5 is increased due to pressure compensation performed for main operation valve 5.

However, in the present embodiment, as described above, even if the differential pressure across main operation valve 5 comes to be lower than the differential pressure across main operation valve 82, no pressure compensation is performed for main operation valve 5 and, therefore, the apparent differential pressure across main operation valve 5 is not increased. Further, when the differential pressure across main operation valve 82 comes to be lower than the differential pressure across main operation valve 5, pressure compensation is performed for main operation valve 82, which suppress the supply of the hydraulic oil to arm cylinder 7, in comparison with cases of not performing such pressure compensation.

Therefore, with hydraulic system 109A, it is possible to supply a larger amount of the hydraulic oil to bucket cylinder 4, in comparison with structures adapted to perform pressure compensation on main operation valve 5. Accordingly, in cases of performing control for making the amount of the hydraulic oil discharged from first hydraulic pump 2 be larger than the amount of the hydraulic oil discharged from second hydraulic pump 3, it is possible to prevent reduction of the amount of the hydraulic oil supplied to bucket cylinder 4 due to pressure compensation performed on main operation valve 5.

Further, main operation valve 82 and pressure compensation valve 83 are examples of "the second main operation valve" and "the second pressure compensation valve", respectively.

<Summary>

The structure of work vehicle 100 according to the present embodiment and the advantages provided by this structure will be summarized as follows. Incidentally, the matters described in the section of "<Summary>" in the first embodiment also apply to the present embodiment and, therefore, will not be described redundantly.

Work vehicle 100 further includes bucket cylinder 4 for driving bucket 107, arm cylinder 7 for driving arm 106, main operation valve 5 that is connected to discharge hydraulic oil passage 10 and is for supplying the hydraulic oil to bucket cylinder 4, main operation valve 82 for supplying the hydraulic oil discharged from first hydraulic pump 2 to arm cylinder 7 through discharge hydraulic oil passage 10, pressure compensation valve 6 provided between bucket cylinder 4 and main operation valve 5, and pressure compensation valve 83 provided between arm cylinder 7 and main operation valve 82. The pressure compensation valve 83 performs an operation for increasing the differential pressure between the inlet-side port and the outlet-side port of pressure compensation valve 83 to make the differential pressure between the inlet-side port of main operation valve 82 and the outlet-side port of pressure compensation valve 83 be equal to the differential pressure between the inlet-side port and the outlet-side port of main operation valve 5, when the differential pressure between the inlet-side port and the outlet-side port of main operation valve 82 comes to be lower than the differential pressure between the inlet-side port and the outlet-side port of main operation valve 5.

With this structure, in cases of performing control for making the amount of the hydraulic oil discharged from first hydraulic pump 2 be larger than the amount of the hydraulic oil discharged from second hydraulic pump 3, pressure compensation is performed on main operation valve 82. This reduces the amount of the hydraulic oil supplied to arm cylinder 7. This can prevent reduction of the amount of the hydraulic oil supplied to bucket cylinder 4.

The embodiments disclosed herein are merely illustrative and the present invention is not limited to the aforementioned contents. The scope of the present invention is defined by the claims, and all changes which come within the meaning and range of equivalency of the claims are therefore intended to be embraced therein.

REFERENCE SIGNS LIST

1: engine, 2: first hydraulic pump, 2*a*, 3*a*: swash plate, 3: second hydraulic pump, 4: bucket cylinder, 5, 8, 51, 52, 53, 61, 62, 82: main operation valve, 6, 9, 83: pressure compensation valve, 6*a*, 6*b*, 9*a*, 9*b*, 83*a*, 83*b*: pressure receiving portion, 6*c*, 9*c*, 83*c*: spring, 7: arm cylinder, 10, 11: discharge hydraulic fluid passage, 12: communication passage, 13, 21: diverging/merging valve, 13*a*, 21*a*: electromagnetic solenoid, 14: controller, 15, 18, 22, 84: shuttle valve, 16, 19, 23, 24: load-pressure introducing hydraulic oil passage, 17, 20: holding-pressure introducing hydraulic oil passage, 25, 26: servo mechanism, 27, 28: pressure sensor, 29, 30: operation lever, 31, 32: amount-of-operation detection sensor, 54, 63: relief valve, 55, 64: unloading valve, 91, 92, 93: hydraulic oil passage, 95, 95*a*: first hydraulic system, 96: second hydraulic system, 99: merging block, 100: work vehicle, 101: travelling member, 103: revolving member, 104: work implement, 105: boom, 106: arm, 107: bucket, 109, 109*a*: hydraulic system

The invention claimed is:

1. A work vehicle comprising:

a bucket;

an arm;

a first hydraulic pump and a second hydraulic pump each for discharging a hydraulic oil;

a first hydraulic oil passage through which the hydraulic oil discharged from the first hydraulic pump flows to drive the bucket;

a second hydraulic oil passage through which the hydraulic oil discharged from the second hydraulic pump flows to drive the arm;

a diverging/merging valve configured to switch between a merging position for causing the first hydraulic oil passage and the second hydraulic oil passage to communicate with each other, and a diverging position for separating the first hydraulic oil passage and the second hydraulic oil passage from each other; and a controller configured to control an amount of the hydraulic oil discharged from the first hydraulic pump, an amount of the hydraulic oil discharged from the second hydraulic pump, and an operation of the diverging/merging valve;

wherein the controller causes the diverging/merging valve to switch from the merging position to the diverging position, when one of a pump pressure in the first hydraulic pump and a pump pressure in the second hydraulic pump comes to be equal to a first predetermined value during an excavation operation, the controller controls the first hydraulic pump and the second hydraulic pump, such that the amount of the hydraulic oil discharged from the first hydraulic pump is larger than the amount of the hydraulic oil discharged from the second hydraulic pump, when the pump pressure in the first hydraulic pump is equal to or more than the first predetermined value, and the controller controls the first hydraulic pump and the second hydraulic pump, such that the amount of the hydraulic oil discharged from the first hydraulic pump is larger than the amount of the hydraulic oil discharged from the second hydraulic pump, when one of the pump pressure in the first hydraulic pump and the pump pressure in the second hydraulic pump is equal to or more than a second predetermined value that is smaller than the first predetermined value.

2. The work vehicle according to claim 1, further comprising a sensor configured to detect the pump pressure in the first hydraulic pump, wherein the controller increases a proportion of the amount of the hydraulic oil discharged from the first hydraulic pump to the amount of the hydraulic oil discharged from the second hydraulic pump, as a value of a result of detection by the sensor increases.

3. The work vehicle according to claim 1, wherein the controller causes the diverging/merging valve to switch from the diverging position to the merging position, when one of the pump pressure in the first hydraulic pump and the pump pressure in the second hydraulic pump comes to be equal to or lower than a third predetermined value that is smaller than the first predetermined value, after the diverging/merging valve is switched from the merging position to the diverging position.

4. The work vehicle according to claim 1, wherein the controller controls the first hydraulic pump and the second hydraulic pump, such that the amount of the hydraulic oil discharged from the first hydraulic pump is larger than the amount of the hydraulic oil discharged from the second hydraulic pump, until the diverging/merging valve is switched from the diverging position to the merging position, after the diverging/merging valve is switched from the merging position to the diverging position.

5. The work vehicle according to claim 1, further comprising:

a first actuator configured to drive the bucket;

a second actuator configured to drive the arm;

a first main operation valve, connected to the first hydraulic oil passage, configured to supply the hydraulic oil to the first actuator;

a second main operation valve configured to supply the hydraulic oil discharged from the first hydraulic pump to the second actuator, through the first hydraulic oil passage;

a first pressure compensation valve provided between the first actuator and the first main operation valve; and a second pressure compensation valve provided between the second actuator and the second main operation valve, wherein the second pressure compensation valve performs an operation for increasing a differential pressure between an inlet-side port and an outlet-side port of the second pressure compensation valve to make a differential pressure between an inlet-side port of the second main operation valve and the outlet-side port of the second pressure compensation valve be equal to a differential pressure between an inlet-side port and an outlet-side port of the first main operation valve, when a differential pressure between the inlet-side port and an outlet-side port of the second main operation valve comes to be lower than the differential pressure between the inlet-side port and the outlet-side port of the first main operation valve.

6. A hydraulic control method for a work vehicle, the work vehicle including a diverging/merging valve configured to switch from one position of a merging position and a diverging position to the other position of the merging position and the diverging position, the merging position being for causing a first hydraulic oil passage and a second hydraulic oil passage to communicate with each other, the diverging position being for separating the first hydraulic oil passage and the second hydraulic oil passage from each other, the first hydraulic oil passage being adapted to flow a hydraulic oil discharged from a first hydraulic pump for driving a bucket, and the second hydraulic oil passage being adapted to flow the hydraulic oil discharged from a second hydraulic pump for driving an arm, the method comprising the steps of:

switching the diverging/merging valve from the merging position to the diverging position;

in response to a pump pressure in the first hydraulic pump being equal to or more than a first predetermined value, controlling the first hydraulic pump and the second hydraulic pump such that an amount of the hydraulic oil discharged from the first hydraulic pump is larger than an amount of the hydraulic oil discharged from the second hydraulic pump; and in response to one of the pump pressure in the first hydraulic pump and a pump pressure in the second hydraulic pump being equal to or more than a second predetermined value that is smaller than the first predetermined value, controlling the first hydraulic pump and the second hydraulic pump such that the amount of the hydraulic oil discharged from the first hydraulic pump is larger than the amount of the hydraulic oil discharged from the second hydraulic pump.

* * * * *